US009221295B2

(12) United States Patent
Herapath et al.

(10) Patent No.: US 9,221,295 B2
(45) Date of Patent: Dec. 29, 2015

(54) APPARATUS AND METHOD TO CONTROL MATERIAL CONVERTING AND ENVELOPE STUFFING

(75) Inventors: Kevin Herapath, Port Perry (CA); George Forystek, Powell, OH (US)

(73) Assignee: Kern Global LLC, Grove City, OH (US)

( * ) Notice: Subject to any disclaimer, the term of this patent is extended or adjusted under 35 U.S.C. 154(b) by 208 days.

(21) Appl. No.: 12/755,075

(22) Filed: Apr. 6, 2010

(65) Prior Publication Data

US 2010/0251673 A1 Oct. 7, 2010

Related U.S. Application Data

(60) Provisional application No. 61/166,988, filed on Apr. 6, 2009.

(51) Int. Cl.

| | |
|---|---|
| ***B65B 57/00*** | (2006.01) |
| ***B43M 3/04*** | (2006.01) |
| ***B65H 43/00*** | (2006.01) |

(52) U.S. Cl.

CPC ..... *B43M 3/04* (2013.01); *B65H 43/00* (2013.01); *B65H 2511/20* (2013.01); *B65H 2513/40* (2013.01); *B65H 2553/00* (2013.01); *B65H 2557/12* (2013.01); *B65H 2801/66* (2013.01)

(58) Field of Classification Search

CPC ..... B65H 2701/1916; B65H 2801/78
USPC ..... 493/186, 917; 53/55, 58, 498, 500, 569, 53/284.3, 381.3, 381.5, 429
See application file for complete search history.

(56) References Cited

U.S. PATENT DOCUMENTS

| | | | | |
|---|---|---|---|---|
| 3,490,761 | A * | 1/1970 | Bell | 270/52.02 |
| 5,092,575 | A | 3/1992 | Ramsey | |
| 5,095,682 | A * | 3/1992 | Steidinger | 53/411 |
| 5,282,350 | A * | 2/1994 | Crowley | 53/435 |
| 5,445,367 | A * | 8/1995 | Long | 270/1.03 |
| 5,538,232 | A * | 7/1996 | Long | 270/1.03 |
| 7,254,931 | B2 * | 8/2007 | Stemmle et al. | 53/460 |
| 7,539,547 | B2 * | 5/2009 | Stange et al. | 700/17 |
| 7,735,296 | B2 * | 6/2010 | Momich | 53/250 |

(Continued)

FOREIGN PATENT DOCUMENTS

| | | | |
|---|---|---|---|
| EP | 1053963 | A2 * | 11/2000 |
| EP | 1683651 | A2 | 7/2006 |

OTHER PUBLICATIONS

European Patent Office, International Search Report and Written Opinion, from corresponding PCT/US2010/030088, dated Jun. 15, 2010, 13 pp.

*Primary Examiner* — Stephen F Gerrity
*Assistant Examiner* — Eyamindae Jallow
(74) *Attorney, Agent, or Firm* — Wood, Herron & Evans, LLP

(57) ABSTRACT

An apparatus and method for stuffing envelopes is disclosed. The apparatus includes a plurality of prime movers, a plurality of sensors disposed throughout the apparatus, and a central controller. The prime movers, the sensors and the central controller are operably interconnected such that the central controller directly receives signals from the sensors and from the plurality of prime movers for real-time control of at least one prime mover from the plurality of prime movers based upon determined movement of at least one of a discrete sheet of material, a stack of sheets of material or a stuffed envelope through at least a portion of the apparatus.

12 Claims, 16 Drawing Sheets

(56) References Cited

U.S. PATENT DOCUMENTS

| | | | | |
|---|---|---|---|---|
| 7,930,869 | B2 * | 4/2011 | Rozenkranz | 53/473 |
| 8,144,718 | B2 | 3/2012 | Schwenkel et al. | |
| 8,181,424 | B2 * | 5/2012 | Rosenkranz | 53/55 |
| 2004/0123571 | A1 | 7/2004 | Rozenfeld | |
| 2004/0178555 | A1 | 9/2004 | Mayer et al. | |
| 2006/0185326 | A1 * | 8/2006 | Woodman et al. | 53/429 |
| 2007/0186144 | A1 * | 8/2007 | Stange et al. | 715/500 |
| 2009/0044491 | A1 * | 2/2009 | De Pietra et al. | 53/396 |
| 2010/0152009 | A1 * | 6/2010 | Edel | 493/210 |
| 2010/0213769 | A1 * | 8/2010 | Sakakibara | 307/82 |

* cited by examiner

APPARATUS AND METHOD TO CONTROL MATERIAL CONVERTING AND ENVELOPE STUFFING

CROSS REFERENCE TO RELATED APPLICATION

This application is related to and claims the filing date benefit of U.S. Provisional Patent Application Ser. No. 61/166,988, entitled "APPARATUS AND METHOD TO CONTROL MATERIAL CONVERTING AND ENVELOPE STUFFING," filed Apr. 6, 2009, and the disclosure of which is hereby incorporated by reference herein in its entirety.

FIELD OF THE INVENTION

The present invention is generally related to converting equipment and, more particularly, to the control of converting equipment for collating sheets of material and automatically stuffing envelopes therewith.

BACKGROUND OF THE INVENTION

Converting equipment is known for automatically stuffing envelopes. Such equipment may include components for feeding a pre-printed web of paper, for cutting such web into one or more discrete sheets for collating sheets, and for feeding such discrete sheet collations into envelopes. Such equipment may further include components to convey the stuffed envelopes to a specified location. The industry has long known devices which accomplish these and other functions. However, improvements are needed where high volumes of paper pieces count and high speeds are required without sacrificing reliability, accuracy and quality of end product.

More particularly, a large roll of paper is typically printed in discrete areas with piece specific information. That is, the initial roll of paper comprises vast numbers of discrete areas of already-printed indicia-specific information with each discrete area defining what is to eventually comprise a single page or sheet of indicia specific information. To complicate the process, a variable number of sheets with related indicia must be placed into the envelopes so that the content of one envelope varies from the content of another by sheet count and, of course, by the specific indicia on the included sheets. As one example, financial reports of multiple customers or account specifics may require a varied number of customer or account specific sheets to be cut, respectively collated, stuffed and discharged for delivery. Thus, the contents of each envelope include either a single sheet or a "collation" of from two to many sheets, each "collation" being specific to a mailing to an addressee.

In such an exemplary operation, a financial institution might send billing or invoice information to each of its customers. The billing information or "indicia" for one customer may require anywhere from one final sheet to a number of sheets which must be collated, then placed in that customer's envelope. While all this information can be printed in sheet size discrete areas, on a single roll, these areas must be well defined, cut, merged or collated into sheets for the same addressee or destination, placed into envelopes, treated and discharged. Thus, a system for conducting this process has in the past included certain typical components, such as a paper roll stand, drive, sheet cutter, merge unit, accumulate or collate unit, folder, envelope feeder, envelope inserter, and finishing and discharge units. Conventional electronic controls are used to operate the system to correlate the functions so correct sheets are collated and placed in correct destination envelopes.

In such conventional systems, the pass-through rate from paper roll to finished envelope is dependent on the speed of each component, and overall production speed is a function of the slowest or weakest link component. Overall reliability is similarly limited. Moreover, the mean down time from any malfunction or failure to repair is limited by the most repair-prone, most maintenance consumptive component. Such conventional systems are capital intensive, requiring significant floor plan or footprint, and require significant labor, materials and maintenance capabilities and facilities.

Moreover, controlling conventional systems is often costly and inefficient. For example, conventional systems utilizing system buses often run at slow bus speeds and require the use of a plurality of custom configured computing systems to operate a plurality of components. Specifically, use of a plurality of custom configured computing systems increases the latency for operative control of conventional systems, as each message to any of the custom configured computing system is received, translated and processed by each custom configured computing system. Additionally, use of the plurality of custom configured computing systems increases the latency for communications on a bus line, increases the amount of synchronization required to keep each of the plurality of custom configured computing systems running at the same speed and with the same clock synchronization, increases the overall complexity of program code to operate the conventional system and thus the time required to execute that program code, and is subject to wasted processing time dealing with handing off and receiving of messages that are not addressed to a particular custom computing system, processor thereof and/or component related thereto. Moreover, the use of a plurality of custom configured computing systems results in the increased likelihood of failure due to the additional hardware required, the potential unreliability of custom components, configurations and/or architectures, as well as the requirement of the use of a vast number of oftentimes expensive components, configurations and/or architectures. For example, each processor of each custom configured computing system may be configured on a custom board with related (and also possibly custom configured) supporting components, such as memory, bus controllers, I/O controllers, storage controllers, etc. The increased hardware and complexity, in turn, results in an increased likelihood of failure of such conventional systems.

Furthermore, conventional systems may be incapable of providing real-time control of the operations thereof. For example, each module of a conventional system may follow its own business rules based on the typical timing required to move a document from a first position to a second position. In such systems, related inaccuracies in knowing the exact movement or location of a particular document are accounted for by building in windows for controlling particular components of the systems, which prevents the operation thereof at greater speeds. Additionally, related inaccuracies may prevent tracking of any particular document within a conventional system. Thus, neither the exact operation of conventional systems, nor data associated with documents being processed in the conventional systems, can be tracked or controlled in real-time.

Accordingly, it is desirable to provide an improved apparatus and related methods of controlling converting equipment that address the problems of conventional systems of the type described above.

SUMMARY OF THE INVENTION

Embodiments of the invention provide apparatuses for stuffing envelopes and methods of controlling same. Consistent with one embodiment of the invention, the apparatus includes a plurality of prime movers, a plurality of sensors disposed throughout the apparatus, and a central controller. The plurality of prime movers, the plurality of sensors and the central controller are operably interconnected such that the central controller directly receives signals from the plurality of sensors and from the plurality of prime movers for real-time control of at least one prime mover from the plurality of prime movers based upon determined movement of at least one of a discrete sheet of material, a stack of discrete sheets of material or a stuffed envelope through at least a portion of the apparatus. In those embodiments, the plurality of prime movers, the plurality of sensors and the central controller may be configured to be controlled and/or communicate through an EtherCAT® protocol. Specifically, the EtherCAT® protocol may be an Ethernet® based fieldbus protocol in which EtherCAT® enabled devices read data addressed to them in a frame while passing the frame through the device. Input data from that EtherCAT® enabled device may be inserted into the frame while the frame passes through the device. Accordingly, the apparatus is capable of controlling movement of a web, discrete sheet of material, or a stack of such materials based on input directly received by the central controller and associated with movement of a discrete sheet of material, a stack of discrete sheets of material or a stuffed envelope that is downstream from the location of controlling action (e.g., corrective action).

In some embodiments, a method of controlling an apparatus configured to stuff envelopes with a central controller of the type that includes a processing unit and a memory is provided. The method includes communicably coupling a plurality of prime movers of the apparatus and a plurality of sensors of the apparatus to the central controller and receiving signals from the plurality of prime movers and the plurality of sensors at the central controller. The method further includes determining the movement of at least one of a discrete sheet of material, a stack of discrete sheets of material, and a stuffed envelope through at least a portion of the apparatus and selectively controlling the operation of at least one prime mover from the plurality of prime movers in real-time based upon the determined movement.

Such apparatuses and methods are particularly useful in a paper converting and envelope stuffing system contemplating improved paper converting and sheet inserting apparatuses and methods, modular based operation, and/or having improved paper handling apparatuses, servo driven components, improved sensor density as well as improved control concepts controlling the system operation. One or more of the embodiments of the invention contemplate improved reliability and speed of improved paper converting and sheet inserting apparatuses and methods by utilizing a plurality of EtherCAT® enabled devices configured to interact with respective portions of the apparatus that advantageously do not have to receive, interpret and process every part of each frame. Rather, the EtherCAT® enabled devices interact with only their portion of a passing frame, thus increasing the rate of operation that the apparatus may be operated at while also streamlining control of the apparatus to one, or a very few, computing systems. Moreover, utilizing these devices allows for the control of the operation of the apparatus in real-time. For example, at least a portion the apparatus may be monitored in real-time for a comparison of the operation thereof to an exemplary virtual converter as well as monitored for variations that may indicate future degradation and non-standard operation. In response to the monitored operation, the portion of the apparatus, or another portion of the apparatus, may be sped up, slowed down or otherwise halted.

In addition, one or more of the embodiments of the invention contemplate utilizing the EtherCAT® enabled devices to avoid utilizing custom computing devices to control at least one component of the apparatus. Rather, the at least one component of the apparatus may be controlled directly through the EtherCAT® enabled devices, which may be configured to merely convert the data in a frame directed to that EtherCAT® enabled device into an electrical signal for its respective at least one component to control that at least one component. In some embodiments, the at least one component may be an Ethercat® enabled device itself such that it is directly controlled. As such, some or all of the EtherCAT® enabled devices may be off the shelf devices that are hot-swappable and automatically configured, advantageously avoiding proprietary and costly custom computing systems, configurations and architectures. Moreover, in some embodiments, utilizing the EtherCAT® enabled devices allows for the centralized controlling of the apparatus without multiple synchronized clock signals required at various parts of the apparatus, thus decreasing the complexity of not only communication but also operation of the apparatus.

Furthermore, one or more embodiments of the invention contemplate tracking information associated with a document, a group of documents and/or a stuffed envelop as it proceeds through the apparatus. As such, information associated with any of the documents currently being processed or that has been processed may be determined. Specifically, documents, groups and/or stuffed envelopes that differ from others may be processed appropriately according to characteristics associated therewith. For example, a first document may have a first thickness and thus associated with a first speed at which to capture the document (e.g., a first "capture" speed) while a second document may have a second thickness and is thus associated with a second capture speed. Similarly, a first group of documents may have a first thickness and thus be associated with a first thickness at which to capture the group of documents (e.g., a first "capture" thickness) while a second group of documents may have a second thickness and thus be associated with a second capture thickness.

Thus, in one or more embodiments of the invention, an improved envelope conveying apparatus which can be used as a module of a modular paper converting and sheet insertion system where human capital, required space, required equipment, maintenance, labor and materials and facilities therefore are reduced compared to conventional systems of similar throughput is provided.

More specifically, such improved apparatus and methods contemplate a plurality of functional modules providing the following functions in a series of modules of like or dissimilar modules where a specific module is multi-functional. The functions comprise:

- printed paper roll handling/unwinding;
- paper slitting and cutting;
- sheet collation and accumulation;
- sheet folding;
- transportation for interfacing with inserts;
- envelope feeding;
- collation interfacing and insertion; and
- envelope treating and discharging.

More particularly, one or more aspects of the invention may contemplate, without limitation, new and unique apparatus and methods for:

a) guiding a web of the paper or film containing the printed indicia into a cutter apparatus;
b) processing the web through slitting and transverse-cutting operation;
c) transporting and merging discrete pieces of the insert;
d) accumulating predefined stacks of discrete pieces of the insert;
e) guiding and transporting a stack of discrete pieces of the insert toward an envelope-filling station;
f) transporting individual envelopes toward the envelope-filling station;
g) creating and processing a stack of the envelopes prior to the envelope-filling process; and
h) processing an individual envelope from the stack of envelopes and through the envelope-filling station.

While the combination of the particular functions in the particular modules are unique combinations, the invention of this application lies primarily in the apparatus and methods described herein.

In summary, embodiments of the invention contemplate an improved converter apparatus that is faster, and with more reliability at faster throughput speeds, than conventional converters. Moreover, the use of multiple, custom computing devices is avoided, centralized control without the need for multiple synchronized clock signals is provided, and real time control is accomplished.

These and other advantages will be apparent in light of the following figures and detailed description.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

Figure 1:
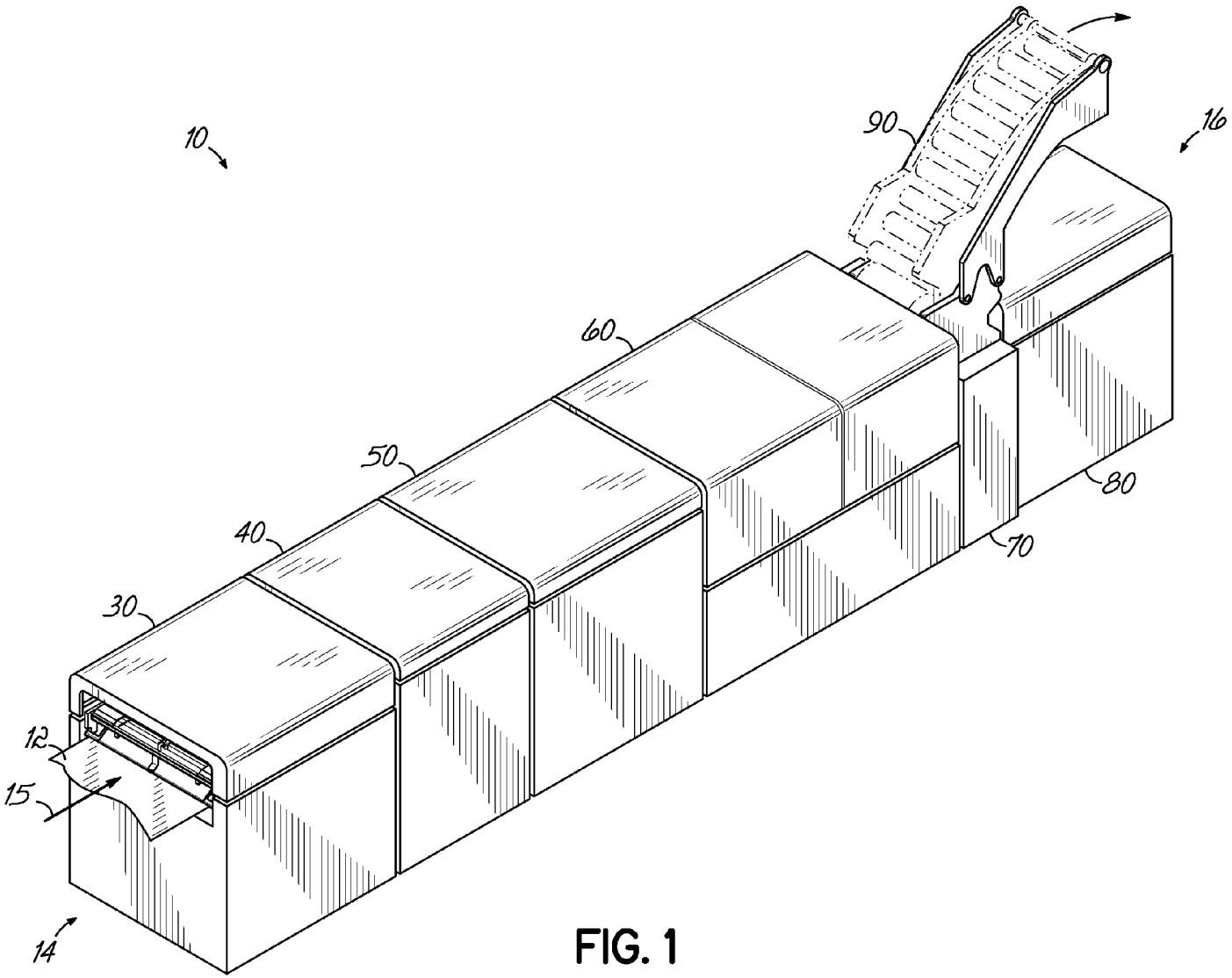
FIG. 1 is a perspective illustration of a portion of a converter for stuffing envelopes with selected paper or film objects consistent with embodiments of the invention.

It should be understood that the appended drawings are not necessarily to scale, presenting a somewhat simplified representation of various preferred features illustrative of the basic principles of embodiments of the invention. The specific features consistent with embodiments of the invention disclosed herein, including, for example, specific dimensions, orientations, locations, sequences of operations and shapes of various illustrated components, will be determined in part by the particular intended application, use and/or environment. Certain features of the illustrated embodiments may have been enlarged or distorted relative to others to facilitate visualization and clear understanding

DETAILED DESCRIPTION

This application is generally related to the following copending U.S. patent application Ser. No. 12/231,739, entitled "Apparatus for Guiding and Cutting Web Products and Related Methods;" Ser. No. 12/231,755, entitled "Envelope Conveying and Positioning Apparatus and Related Methods;" Ser. No. 12/231,753, entitled "Inserting Apparatus for Discrete Objects into Envelopes and Related Methods;" Ser. No. 12/231,754, entitled "Transporting Apparatus for Discrete Sheets into Envelopes and Related Methods;" Ser. No.

12/231,730, entitled "Conveying Apparatus for Envelopes and Related Methods;" and Ser. No. 12/231,749, entitled "Transporting Apparatus for Web Products and Related Methods," all being filed on Sep. 9, 2008 and expressly incorporated herein by reference in their entirety. This application is also generally related to the following co-pending International Patent Applications filed on even date herewith, and the disclosures of which are also expressly incorporated herein by reference in their entirety: Serial No. PCT/US2010/030066, entitled "Accumulator Apparatus for Discrete Paper of Film Objects and Related Methods;" and Serial No. PCT/US2010/030085, entitled "Transporting Apparatus with Unobstructive Elements and Related Methods."

In some embodiments consistent with the invention, a converter configured to convert a web of material into discrete documents for processing and stuffing into envelopes is also configured to communicate with a central controller through a framed network fieldbus communication protocol, such as the EtherCAT® protocol. Specifically, the converter is configured with a plurality of EtherCAT® enabled devices and controlled by the central controller to process at least one document and stuff that at least one document into at least one envelope based on the location and/or movement of the at least one document or stuffed envelope through the converter. By utilizing the EtherCAT® protocol, it is believed that communication delays inherent with conventional communication are at least partially avoided. Specifically, conventional systems require sending a communication (e.g., a message) for any node to each of a plurality of nodes. Each node individually processes the message and, if required, sends a response. This results in a plurality of messages per cycle per node, and typically requires redirection of messages until they reach the node that message is for. Accordingly, there is an increased cost to supply, update, maintain and operate that plurality of nodes in conventional systems.

Disadvantageously, it is believed that sending messages to the plurality of nodes also increases average response times of the nodes, as any message is delayed by having to be processed by nodes to which that message is not intended. Thus, a node may spend time processing messages not intended for that node before processing a message that is intended for that node. As such, real-time control of conventional systems is believed to be prevented.

It is believed that providing the converter with devices configured to communicate at least by way of the EtherCAT® protocol decreases the communication required by the central controller, decreases the bandwidth required for communication in the converter, and decreases the associated hardware and overhead to control the converter. Additionally, by utilizing a central controller configured to control the converter by way of EtherCAT® communications, it is believed that the converter may be controlled in real-time and configured to operate at a speed from about 33,000 pieces of discharged filled envelopes per hour to upward of about 40,000 pieces of discharged filled envelopes per hour. Even further, it is believed that coupling a plurality of prime movers, a plurality of sensors and/or a central controller by way of the EtherCAT® protocol provides a manner of controlling the converter based upon determined movement of a discrete sheet of material, a stack of discrete sheets of material and/or a stuffed envelope through at least a portion of the apparatus.

Specifically, EtherCAT® communications are provided by at least one central controller, which may be a computing system, configured to communicate on a high speed bus, which in turn communicates with discrete EtherCAT® enabled devices. However, to address all the devices the computing system sends only one EtherCAT® communication. This communication may include data for each of the devices, which are configured to respond to only their portion of the EtherCAT® communication. As a result, the converter is configured to provide real-time status checks, real-time data capture, open interfacing to additional protocols, increased diagnostics capabilities, internet connectivity with the ability to get to the I/O level and not impact real-time processor, safety circuit integration with the EtherCAT® protocol, lower cost due to the simplicity of EtherCAT® devices, as well as lower maintenance cost through the use of hot-swappable and hot-pluggable EtherCAT® enabled devices. This, in turn, results in real time corrective actions based on operational rules or predetermined algorithms that can leverage information about the size, orientation and/or location of a document, group of documents and/or stuffed or filled envelope to control the converter.

Referring to the figures and, more particularly to FIG. 1, a portion of an exemplary converter 10 is illustrated for processing a web 12 of paper or film. Although not shown, the web 12 processed by the converter 10 originates, for example, from a roll (not shown) of material containing such web. The roll is generally associated with a first end 14 of the converter 10 and is unwound in ways known in the art, for example, by driving a spindle receiving a core of the roll or by contacting a surface of the roll with a belt or similar apparatus. Typically, the web 12 is pre-printed with indicia in discrete areas.

The web 12 thus travels in a machine direction, generally indicated by arrow 15, through several modules that make up the converter 10. In the exemplary embodiment of FIG. 1, converter 10 cuts the web material into discrete sheets (corresponding to the "areas") of material ("inserts") and feeds them into envelopes fed generally from an opposite end 16 of converter 10. Converter 10 may further convey the envelopes containing the inserts away from the shown portion of the converter 10 for subsequent processing or disposition. The exemplary converter 10 includes, as noted above, several modules for effecting different steps in the processing of the web and the inserts resulting therefrom, as well as processing of the envelopes. Those of ordinary skill in the art will readily appreciate that converter 10 may include other modules in addition or instead of those shown herein.

A first of the shown modules, for example, is a cutting module 30 relatively proximate first end 14 of the converter 10 and which cuts the web 12 in ways to be described in further detail below. Cutting module 30 cuts the web into discrete inserts (e.g., documents) (not shown) for subsequent processing. A conveying module 40 controls and transports the documents received from the cutting module and feeds them into a folding and buffering module 50. Alternatively or additionally, the folding and buffering module 50 may receive inserts from a sheet feeder (not shown) supplying pre-cut discrete inserts i.e., discrete inserts supplied to the converter 10 in their final form and which do not require to be cut by cutting module 30. The folding and buffering module 50 is capable of processing discrete inserts and supply them to the next module in an unfolded form or, when required, supply them to the next module in a folded form. Module 50 may, if necessary, form stacks of documents for subsequent processing, for example, if the intended production requires stuffing the envelopes with more than one document. Module 50 folds the documents, if required by the intended production, along a longitudinal axis of the documents disposed generally along the machine direction. Moreover, module 50 accumulates, collates or buffers individual documents or groups of documents into individually handled stacks, if the particular production so requires.

With continued reference to FIG. 1, an uptake module 60 takes the documents or groups of documents from folding and buffering module 50 and cooperates with insert feeders to provide inserts to the documents or groups of documents if the particular production so requires inserts. The uptake module then cooperates with components of a stuffing module 70 to transport the single document, documents, or groups of documents and feed them into envelopes. The envelopes, in turn, are handled and fed toward the stuffing module 70 by an envelope conveyor 80. A conveying assembly 90 is operatively coupled to the stuffing module 70 and the envelope conveyor 80 for conveying the stuffed or filled envelopes away from the shown portion of converter 10 for subsequent processing or disposition.

Figure 2:
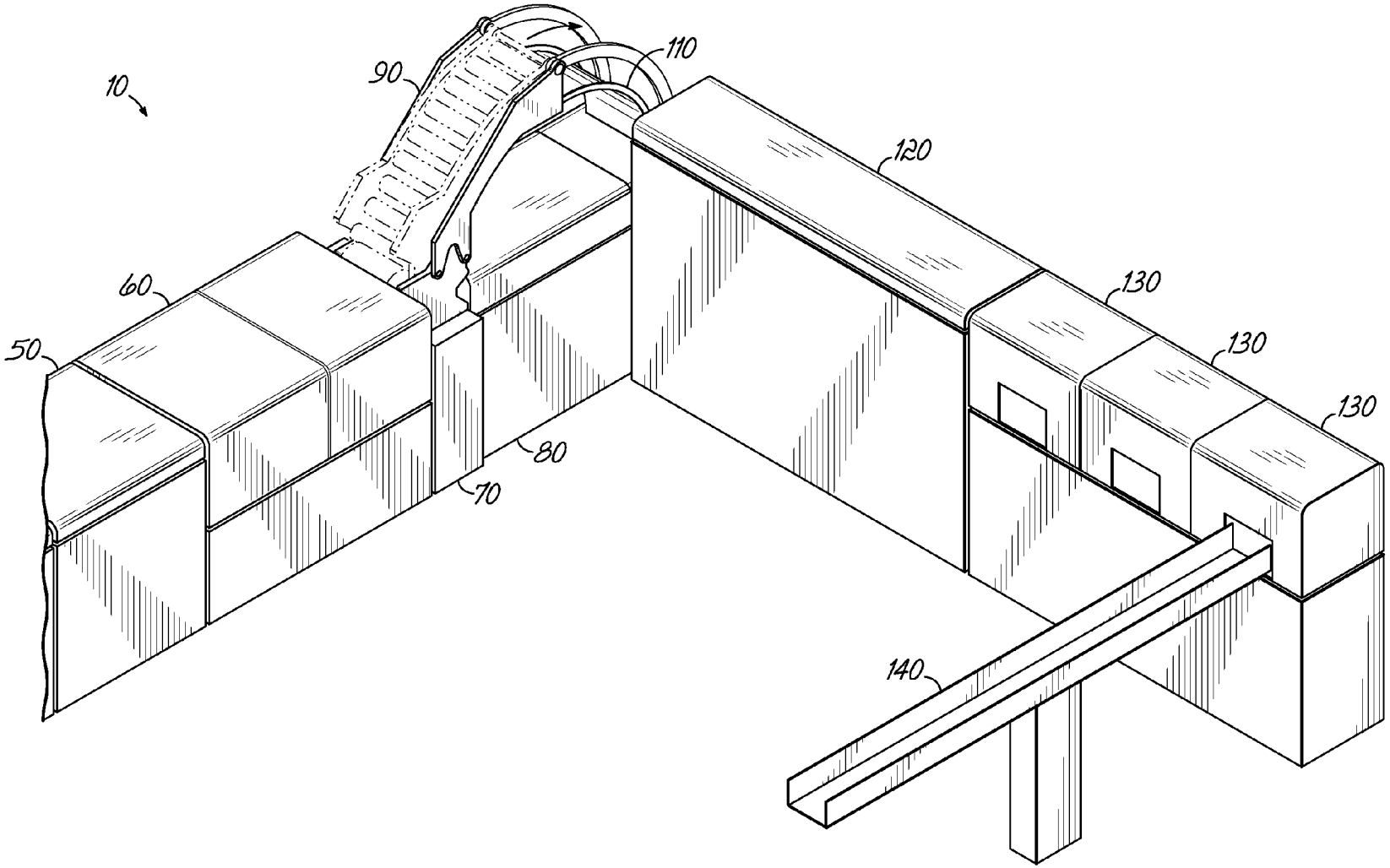
FIG. 2 is a perspective illustration of additional components of the converter of FIG. 1.

With reference to FIG. 2, additional components of the exemplary converter 10 are illustrated. Specifically, FIG. 2 illustrates the operative coupling of the conveying assembly 90 to an orientation unit 110, which in turn is operatively coupled to a loading conveyor 120. From the loading conveyor 120, one or more diverters 130 may divert stuffed or filled envelopes to respective holding gantries 140. Although not illustrated, it will be appreciated that the converter 10 may additionally include a sealing module to seal at least a portion of the stuffed or filled envelopes. Furthermore, and also not illustrated, it will be appreciated that the converter 10 may include a stamping unit (not shown) to apply postage (for example, stamps or printed postage indicia) to at least a portion of the stuffed or filled envelopes. It will be appreciated that the additional components illustrated in FIG. 2 may or may not be operatively coupled to the conveying assembly 90, and that in alternative embodiments the conveying assembly 90 is operatively coupled to a different apparatus for subsequent processing or disposition, and that in further alternative embodiments the conveying assembly is operatively coupled to a bin to deposit stuffed or filled envelopes. Thus, FIG. 1 and FIG. 2 are merely illustrative of one apparatus for processing or disposing of stuffed or filled envelopes, and are not intended to be limiting.

Figure 3:
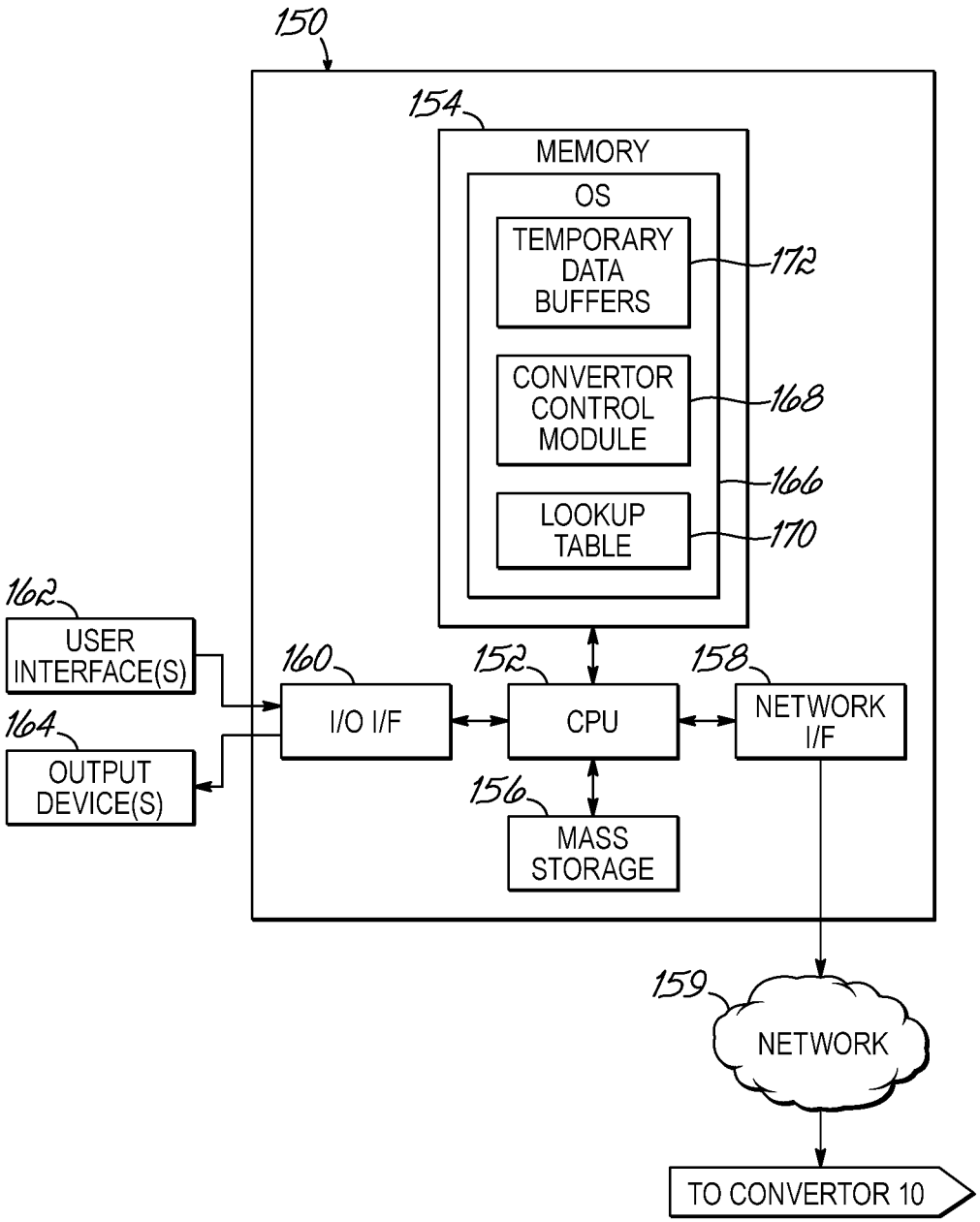
FIG. 3 is a diagrammatic illustration of a central controller for controlling the operation of the converter of FIGS. 1-2.

With reference to FIG. 3, the converter 10 may be controlled by a central controller 150. The central controller 150, for the purposes of this invention, may represent any type of computer, computing system, server, disk array, or programmable device such as a multi-user computer, single-user computer, handheld device, networked device, mobile phone, gaming system, etc. Moreover, the central controller 150 may be implemented using one or more networked computers, e.g., in a cluster or other distributed computing system. Thus, and for the sake of brevity, the central controller 150 will hereinafter be referred to as "computing system" 150.

The computing system 150 includes at least one central processing unit ("CPU") 152 coupled to a memory 154. Each CPU 152 may be one or more microprocessors, micro-controllers, field programmable gate arrays, or Application-Specific Integrated Circuits (ASICs), while memory 154 may include random access memory (RAM), dynamic random access memory (DRAM), static random access memory (SRAM), flash memory, and/or another digital storage medium. As such, memory 154 may be considered to include memory storage physically located elsewhere in the computing system 150, e.g., any cache memory in the at least one CPU 152, as well as any storage capacity used as a virtual memory, e.g., as stored on a mass storage device 156, a computer, or another controller coupled to computer through at least one network interface 158 (illustrated as, and hereinafter, "network I/F" 158) by way of a network 159. In some embodiments, the computing system 150 is communicatively coupled to at least a portion of the converter 10 through the network 159, which communicates with the at least a portion of the converter 10 through the EtherCAT® protocol as developed by Beckhoff Automation GmbH, of Verl, Westphalia, Germany.

The computing system 150 may include the mass storage device 156, which may also be a digital storage medium, and in specific embodiments includes at least one hard disk drive. Additionally, mass storage device 156 may be located externally to the computing system 150, such as in a separate enclosure or in one or more networked computers (not shown), one or more networked storage devices (including, for example, a tape drive) (not shown), and/or one or more other networked devices (including, for example, a server) (not shown). As such, the computing system 150 may be communicatively coupled to the one or more networked computers, one or more networked storage devices and/or one or more other networked devices through the network 159.

The computing system 150 may also include peripheral devices connected to the computer through an input/output device interface 160 (illustrated as, and hereinafter, "I/O I/F" 160). In particular, the computing system 150 may receive data from a user through at least one user interface 162 (including, for example, a keyboard, mouse, a microphone, and/or other user interface) and/or output data to a user through at least one output device 164 (including, for example, a display, speakers, a printer, and/or another output device). Moreover, in some embodiments, the I/O I/F 160 communicates with a device that is operative as a user interface 162 and output device 164 in combination, such as a touchscreen display (not shown).

The computing system 150 may be under the control of an operating system 166 and execute or otherwise rely upon various computer software applications, components, programs, files, objects, modules, etc., consistent with embodiments of the invention. In particular, the computing system 150 may be configured with a converter control module 168 to interface with and control the converter 10. In some embodiments, the converter control module 168 is configured to control the speed and operation of the converter 10, as well as to diagnose errors with the converter 10 and communicate with various components of the converter 10 (e.g., for example, components 30-140, as well as sensors, motors, safety devices, etc. thereof). Specifically, the converter control module 168 is configured to provide real-time status checks and real-time data monitoring, thus providing the ability for controlling action based on operational rules or predetermined algorithms. Controlling action may, for example and without limitation, include corrective action that corrects the direction of movement of discrete inserts required due to inherent variation in the mechanical movement of the inserts (e.g., due to slippage relative to web-traction components; due to loose or misaligned components such as belts). Additionally, the converter control module 168 provides open interfacing with other protocols, which maximizes flexibility and increases diagnostics capabilities. For example, although the converter control module 168 may communicate with components of the converter 10 through EtherCAT®, it may also be configured to communicate with devices associated with the converter 10 that use alternative protocols, such as KBUS, PROFIBUS, RS-422, etc., through one or more protocol converters that convert EtherCAT® communications to respective alternative protocols. For example, safety equipment may communicate through the KBUS protocol, and the converter control module 168 may be configured to control that safety equipment through at least one EtherCAT®-to-KBUS protocol converter configured at the converter 10. Moreover, the converter control module 168 may be configured to upload data to other computers, such as computers communicably coupled to the computing system 150 through the network 159, including through the Internet. Moreover, in some embodiments, the converter control module 168 is configured to simulate the operation of the converter 10 in a "virtual" converter then attempt to match the operation of the converter 10 with the operation of the virtual converter.

In some embodiments, the computing system 150 includes a lookup table 170 that may be used to store a plurality of operational rules or predetermined algorithms with which to operate the converter 10. Specifically, the lookup table 170 may be accessed to determine what to do in response to a particular scenario, a particular occurrence, and/or a particular action. For example, when a user turns on the converter 10, the lookup table 170 may be accessed to determine what startup actions are needed, such as whether to perform a test of components of the converter 10, what speed the converter 10 needs to initially be run, etc. One having ordinary skill in the art will appreciate that, in alternative embodiments, the computing system 150 may not include the lookup table 170, and instead the converter control module 168 may include the operational rules or predetermined algorithms with which to operate the converter 10.

Moreover, the computing system 150 may include a plurality of temporary data buffers 172, each configured to hold data associated with a document, documents and/or stuffed or filled envelope. For example, the plurality of temporary data buffers 172 may include one data buffer for each of the respective cutting module 30, conveying module 40, folding and buffering module 50, uptake module 60, stuffing module 70, envelope conveyor 80, conveying assembly 90, orientation unit 110, loading conveyor 120, diverter 130 and/or gantries 140. As a document, documents and/or stuffed or filled envelope proceed through the converter 10, and in particular components 30-140 of the converter 10, the data may be moved from corresponding buffer to corresponding buffer in the temporary data buffers 172.

Figure 4:
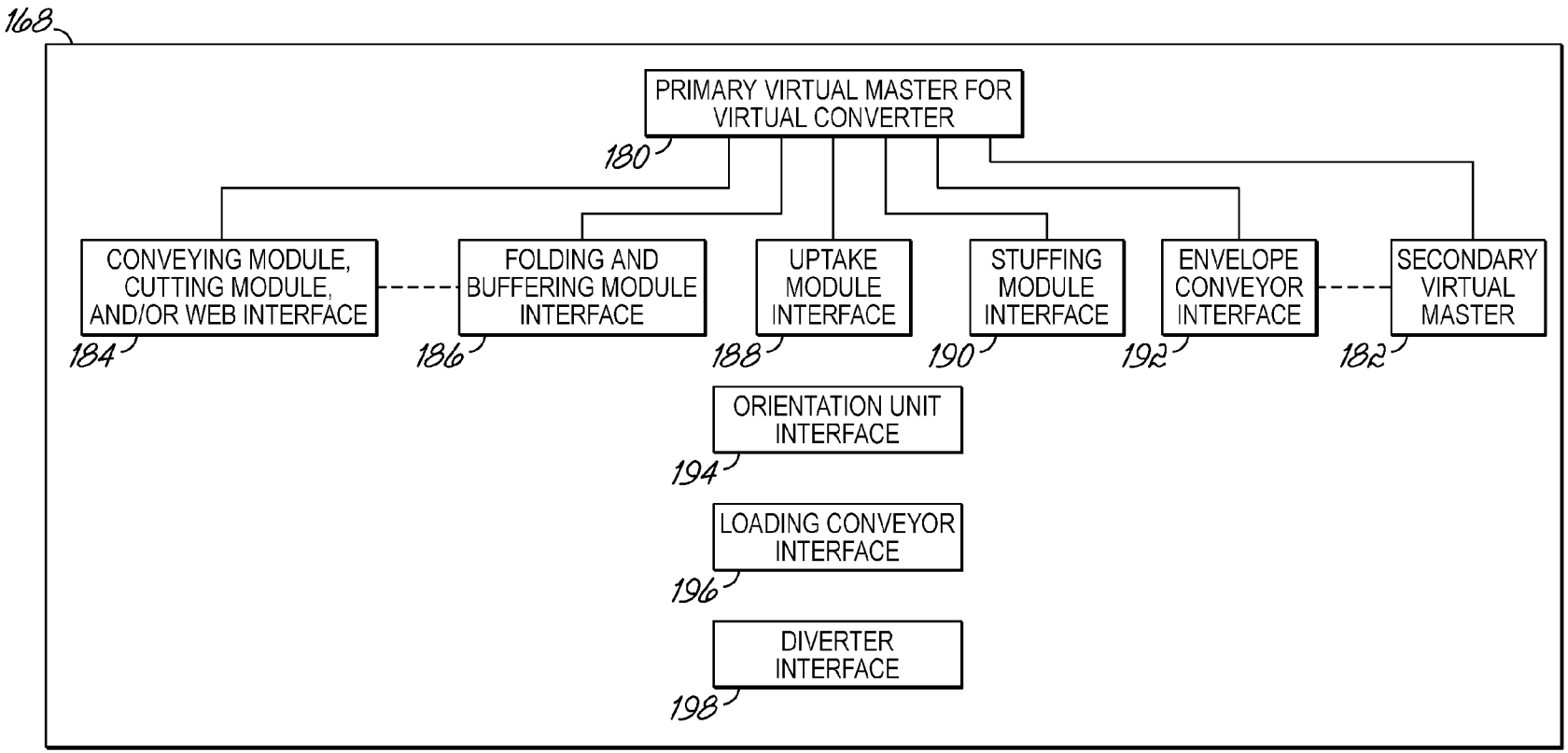
FIG. 4 is a diagrammatic illustration of a plurality of interfaces included in a converter control module of the central controller of FIG. 3 to control the operation of the converter of FIGS. 1-2.

With reference to FIG. 4, a plurality of interfaces that may be included in the converter control module 168 to control the converter 10 are diagrammatically illustrated. Specifically, the converter control module 168 may include a primary virtual master 180 configured to control a secondary virtual master 182. The primary virtual master 180 (hereinafter, "PVM" 180) may be a portion of the virtual converter (e.g., for example, a motor, a chain, a roller, an axis of revolution of an individual part of the virtual converter, another prime mover of the converter 10) used to control the operation of a virtual converter and thus the operation of the converter 10. For example, the PVM 180 may be controlled at a specific rate, and the operation of at least a portion of the rest of the virtual converter may be dependent on the operation of the PVM 180. Specifically, the secondary virtual master 182 (hereinafter, "SVM" 182) may be dependent on the operation of the PVM 180. For example, the SVM 182 may be a portion of the virtual converter that is virtually coupled to the PVM 180. As such, the converter control module 168 may attempt to synchronize the operation of the converter 10 to the operation of the virtual converter, and thus synchronize the PVM 180, SVM 182 and/or other parts and/or components of the virtual converter to a respective primary master, secondary master, and/or other parts and/or components of the converter 10. Thus, the virtual converter, and more specifically the PVM 180, may be used as a reference to control the operation the converter 10.

In addition to the PVM 180 and the SVM 182, the converter control module 168 may include a folding and a cutting, conveying and/or web interface 184 (e.g., an "input" interface 184) to control the feed of the web 12 into the cutting module 30, the cutting module itself 30 and/or the conveying module 40. Similarly, the converter control module 168 may include a folding and buffering module interface 186, an uptake module interface 188, a stuffing module interface 190, an envelope conveyor interface 192, an orientation unit interface 194, a loading conveyor interface 196 and a diverter interface 198 for each of the respective folding and buffering module 50, uptake module 60, stuffing module 70, envelope conveyor 80, orientation unit 110, loading conveyor 120 and diverter 130. In some embodiments, the SVM 182, input interface 184, folding and buffering module interface 186, uptake module interface 188, stuffing module interface 190 and the envelope conveyor interface 192 are dependent upon, or "slaved," to the PVM 180, while the orientation unit interface 194, loading conveyor interface 196 and diverter interface 198 are not. As such, the orientation unit 110, loading conveyor 120 and diverter 130 may be controlled independently but with respect to the fact that there is a desire to prevent jamming of the respective orientation unit 110, loading conveyor 120 and diverter 130. In other embodiments, and as suggested by the dashed lines in FIG. 4, one or more of the interfaces may be operatively coupled to the PVM 180 through another one of the interfaces, rather than directly. In the illustrated embodiment, for example, the folding and buffering module interface 186 may be operatively coupled to the PVM 180 through the input interface 184, while the envelope conveyor interface 192 is operatively coupled to the PVM 180 through the SVM 182.

It will be appreciated by one having ordinary skill in the art that more or fewer interfaces may be used without departing from the scope of the invention. For example, a converter 10 may include more or fewer components 30-140, and thus the converter control module 168 may include more or fewer interfaces than those illustrated in FIG. 4. Also for example, a converter 10 may include more or fewer components 30-140, but the converter control module 168 may include fewer interfaces than there are components of the converter. Alternatively, the converter control module 168 may include alternative interfaces than those illustrated. For example, the converter control module 168 may include interfaces for the PVM 180 and SVM 182, as well as interfaces for prime movers, such as motors, conveyors, gears, rollers or rolling elements (e.g., directional rollers, exit rollers, half-moon rollers, etc.), etc., as well as other components, such as vacuum systems, blower systems, brushes, sensors, etc. that may or may not be dependent upon the PVM 180 and/or the SVM 182. Further alternatively, one or more of those additional interfaces may be included within the interfaces 184-198 illustrated in FIG. 4. As such, it will be appreciated by one having ordinary skill in the art that embodiments of the invention should not be limited to the illustrated interfaces, those discussed herein and/or additional interfaces. As such, one having ordinary skill in the art will appreciate that a converter control module 168 with alternative interfaces may be used without departing from the scope of the invention.

In some embodiments, the converter 10 is configured with a plurality of EtherCAT® enabled devices configured to receive and/or respond to an EtherCAT® communication from the computing system 150. Specifically, the devices may be associated with parts, prime movers, portions and/or components of the converter 10, and additionally be controlled and/or controllable by the computing system 150 to operate the converter 10. The EtherCAT® protocol is a real-time Ethernet fieldbus system in which an EtherCAT® communication (e.g., a "frame") is sent from a controller to at least one EtherCAT® enabled device. Each device reads data in the frame addressed to that device, writes data to the frame if data is to be written, then passes the frame on to the next device, back to the previous device (e.g., when the frame is being bounced back from a termination block), or to the computing system 150. In this manner, the computing system 150 may control the operation of a plurality of devices of the converter 10 and/or receive information from the plurality of devices of the converter 10 with one EtherCAT® communication. In some embodiments, this provides the computing system 150 with real-time (or near real-time) control of the converter 10. For example, and in specific embodiments, the computing system 150 is configured to process about 218 frames per cycle of a document, group of documents and/or stuffed or filled envelopes (e.g., a cycle being the time between when a first and second document and/or a group of documents requested, and/or the time between when a first and second document, a group of documents and/or a stuffed or filled envelope exits the converter 10 and/or moves from a first component to a second component of the converter 10).

In light of the foregoing, EtherCAT® enabled devices that may be disposed and/or configured in the converter 10 may include at least one of one or more of the following: communications headers (e.g., for communicating between computing system 150 and/or other EtherCAT® enabled devices), digital and/or analog input/output devices (e.g., for sending and/or receiving digital and/or analog signals), protocol converters (e.g., for converting communications of one protocol to another), splitters (e.g., for splitting a communication to one or more branches) and motors. Each of the devices may be individually addressable by the computing system 150 in one the EtherCAT® communication such that the converter control module 168 can selectively control each device and/or devices coupled thereto consistent with the invention.

Figure 5:
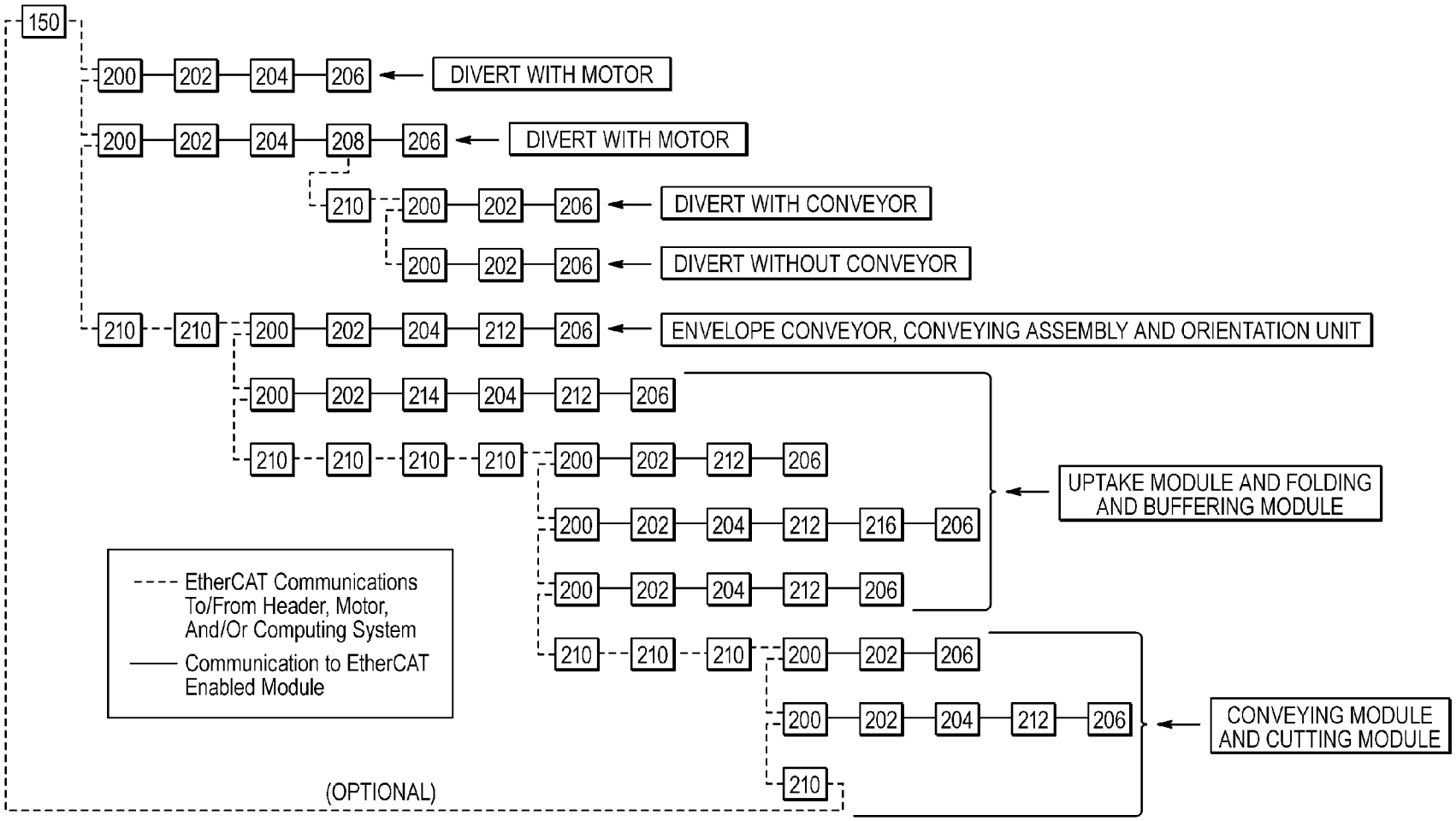
FIG. 5 is a diagrammatic illustration of one coupling of a plurality of EtherCAT® enabled devices in the converter of FIGS. 1-2 that communicate with the central controller of FIG. 3.

With reference to FIG. 5, one coupling of a plurality of EtherCAT® enabled devices (e.g., devices configured to communicate through at least the EtherCAT® protocol) in a converter 10 to the computing system 150, as well as to other EtherCAT® enabled devices, is diagrammatically illustrated. The converter 10 includes at least one communication header 200 configured to receive an EtherCAT® communication and communicate that EtherCAT® communication to at least a portion of the converter 10. As such, each communication header 200 may be coupled to another EtherCAT® enabled device, such as a digital signal input device 202 (e.g., to receive a digital signal, such as from a sensor or another device), a signal output device 204 (e.g., to send an analog and/or digital signal), a KBUS converter 206 (e.g., to convert at least a portion of a communication received at the communication header 200 from the EtherCAT® protocol to the KBUS protocol, or to convert at least a portion of a communication received at the KBUS converter 206 from the KBUS protocol to the EtherCAT® protocol), a splitter 208 (e.g., to provide EtherCAT® communications to at least one additional branch of EtherCAT® enabled components), an RS-422 converter 212 (e.g., to convert at least a portion of a communication received at the communication header 200 from the EtherCAT® protocol to the RS-422 protocol, or to convert at least a portion of a communication received at the RS-422 converter 212 from the RS-422 protocol to the EtherCAT® protocol), an analog signal input device 214 (e.g., to receive an analog signal, such as from a sensor or another device), and/or a PROFIBUS converter 216 (e.g., to convert at least a portion of a communication received at the communication header 200 from the EtherCAT® protocol to the PROFIBUS protocol, or to convert at least a portion of a communication received at the RS-422 converter 212 from the PROFIBUS protocol to the EtherCAT® protocol).

Moreover, a communication header 200 may be configured to pass an EtherCAT® communication to another EtherCAT® enabled communication header 200, a motor 210 and/or back to the computing system 150. For example, and as illustrated in FIG. 5, the various components 200-216 are illustrated as being in a tree-topology. It will be appreciated that each branch of the tree-topology may include at least one termination block (not shown) that is configured to return an EtherCAT® communication back up that branch (e.g., either on the same port lines or a different port line than the EtherCAT® communication proceeded through the branch). Thus, an EtherCAT® communication may proceed from the computing system through all the components to the last component (e.g., the motor 210 at the bottom branch of FIG. 5), then proceed back to the computing system 150. It will be appreciated by one having ordinary skill in the art that the components of the converter 10 may be connected in an alternative fashion than that illustrated. For example, instead of the tree-topology, the components of the converter 10 may be connected in a line topology, a ring topology, a star topology and/or another topology, as well as combinations thereof, as is well known in the art. Moreover, it will be appreciated by one having ordinary skill in the art that the converter 10 may include additional or fewer components than those illustrated, as well as different components than those illustrated. For example, it will be appreciated that each illustration of a block representing the motor 210 may be associated with one or more motors, and that FIG. 5 is simplified for the sake of brevity. Similarly, it will be appreciated that each illustration of a block representing the communication header 200, digital signal input device 202, signal output device 204, KBUS converter 206, splitter 208, RS-422 converter 212, analog signal input device 214, and/or PROFIBUS converter 216 may be associated with one or more respective devices, and that FIG. 5 is simplified for the sake of brevity.

Although not illustrated in FIGS. 1-5, the converter 10 may include a plurality of digital and/or analog sensors. One or more sensors may be coupled to a respective digital signal input device 202 and/or analog signal input device 214, which in turn may provide the signal to the computing system 150 for control of the converter 10. The sensors may include sensors to detect the presence, absence, width, length, thickness, weight, orientation, color, color components and/or other characteristics of a document, group of documents and/or stuffed or filled envelope in various locations of the converter 10 consistent with embodiments of the invention. Moreover, the sensors may include sensors to detect the rotation of characteristics of prime movers of the converter 10 (e.g., motors, rollers or rolling elements, conveyors, gears, etc.) as well as the operational characteristics of portions of the converter 10 (e.g., for example, temperature, speed, rate of processing, etc.). Thus, the sensors may provide feedback to the computing system 150 for control of the converter 10, and in particular provide feedback to the computing system 150 to allow it to track the movement and/or location of a document, a group of documents and/or a stuffed or filled envelope as it moves through the converter 10. Moreover, the sensors may provide feedback to the computing system 150 to allow it to track the operational characteristics of the converter 10. For example, if the converter 10 is running behind the virtual converter, the speed of at least a portion of the converter 10 may be increased for a period of time to synchronize the operation of the converter 10 with the virtual converter consistent with embodiments of the invention. Alternative, if the converter 10 is running ahead of the virtual converter, the speed of at least a portion of the converter 10 may be decreased for a period of time to synchronize the operation of the virtual converter with the converter 10 consistent with embodiments of the invention.

Figure 6:
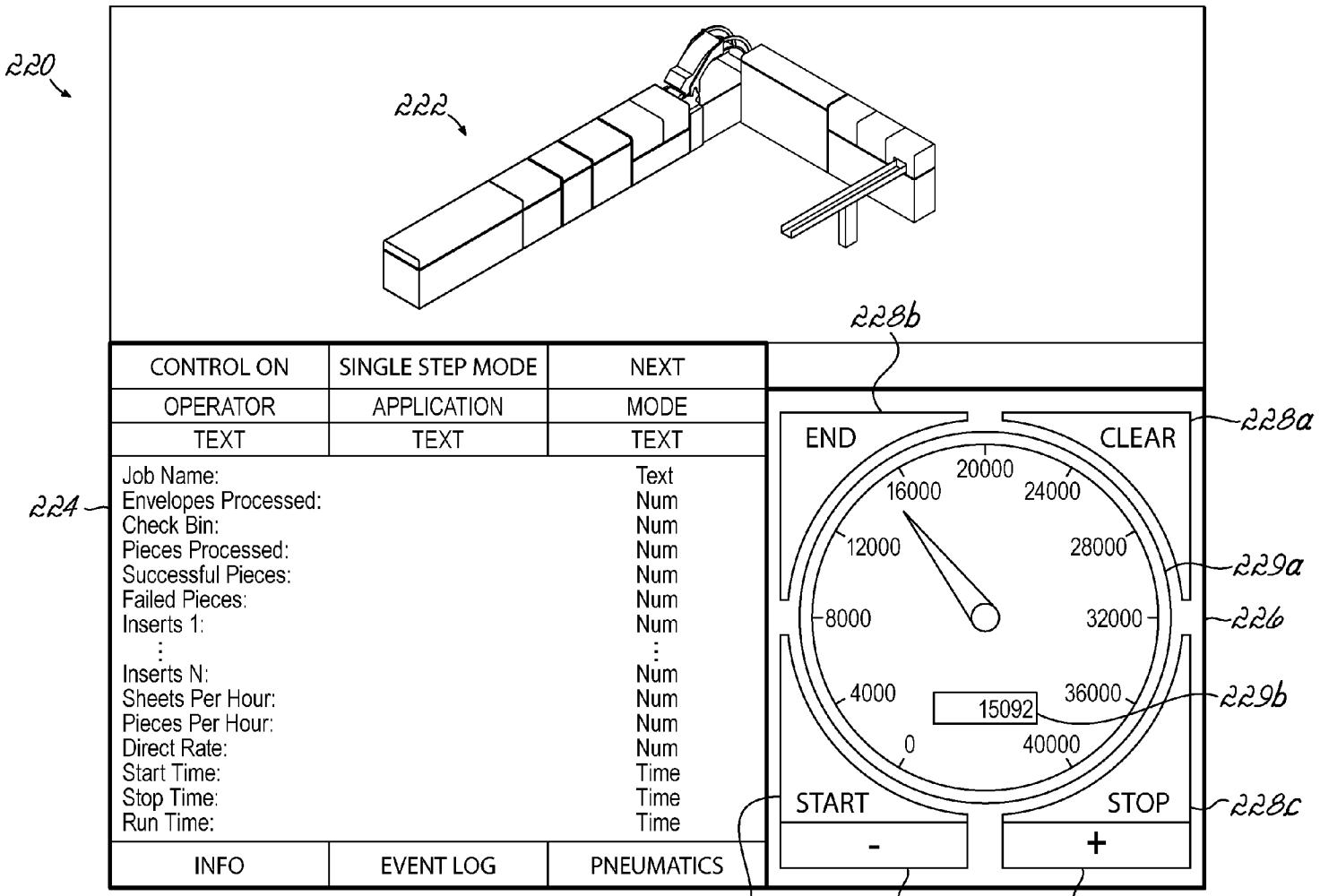
FIG. 6 is a diagrammatic illustration of a display screen that may be provided by the central controller of FIG. 3 to control the operation of the converter of FIGS. 1-2.

With reference to FIG. 6, a display representation of a display screen 220 that may be generated and displayed on a touchscreen device (e.g., a device configured as a user interface 162 and output device 164) and/or an output device 164 coupled to the computing system 150 is illustrated. In some embodiments, the display screen illustrates a display representation of the converter 222, an interactive information pane 224 and an interactive control pane 226. The display representation of the converter 222, in some embodiments, is provided to illustrate the converter 10 and may be further provided to indicate faults with the converter 10. Specifically, at least a portion of the display representation of the converter 222 may be highlighted in response to a corresponding portion of the converter 10 being associated with an error. Alternatively, by selecting a portion of the display representation of the converter 222, associated information may be displayed in the interactive information pane 224 and associated controls may be displayed in the interactive control pane 226.

The interactive information pane 224 may display information about the converter 10 or a portion of the converter 10. For example, and as illustrated in FIG. 6, the interactive information pane 224 displays various information about a job, including the number of envelopes processed, the pieces processed, the number of inserts processed, the rate of processing, the start/stop/run times, etc. The interactive information pane 224 may be interacted with by the user to view more information, such as the event log or pneumatics information. Moreover, the interactive information pane 224 may be interacted with by the user to turn user control off, enter a single step mode, or view additional options.

The interactive control pane 226, on the other hand, may display information about the speed of the converter 10 as well as provide the ability to start and stop the converter, end a job, or clear the information about the converter. Moreover, the interactive control pane 226 offers the ability to increase or decrease the speed of the converter 10 through the respective display representations of a "+" and "−" button. Additionally, the interactive control pane 226 provides the user a quick overview of the speed of the converter through a display representation of an analog indicator showing the number of pieces processed per hour. A digital display may show the exact number of pieces processed per hour. Although the interactive control pane 226 illustrates an indicator with a top speed as 40,000 pieces per hour, one having ordinary skill in the art will appreciate that the indicator may illustrate a higher or lower top speed.

Figure 7:
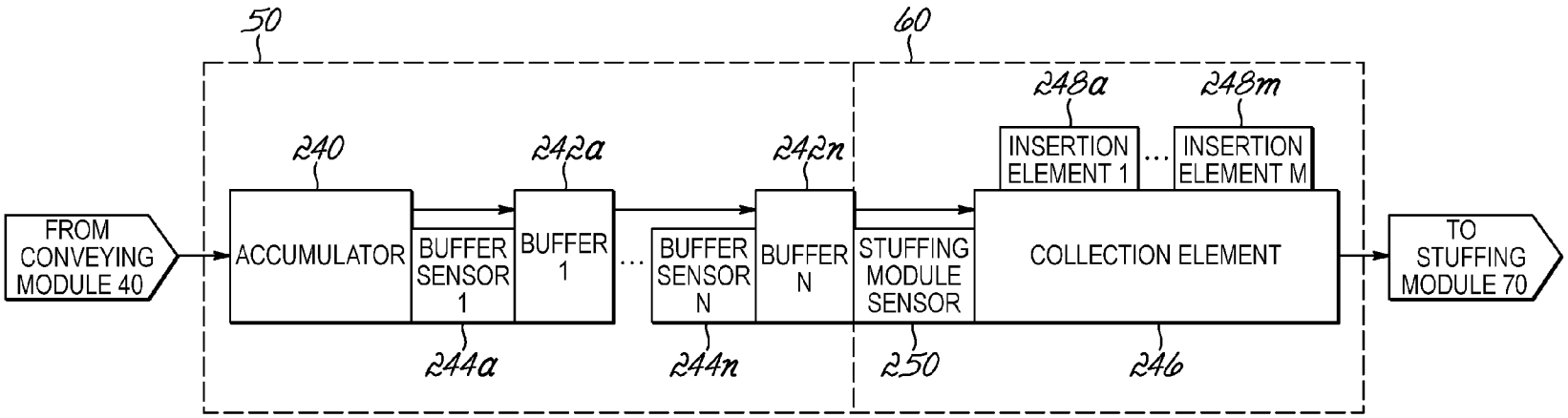
FIG. 7 is a perspective illustration of a portion of a folding and buffering module, as well as a portion of an uptake module, of the converter of FIGS. 1-2.

With reference to FIG. 7, and for example, a perspective view of a portion of the folding and buffering module 50, as well as a portion of the uptake module 60, are diagrammatically illustrated. Specifically, FIG. 7 illustrates that the folding and buffering module 50 may include at least one accumulator 240 configured to accumulate at least one folded or unfolded document into a stack, or group (not shown), a plurality of buffers 242*a-n* configured to buffer the group (e.g., for example, to increase or decrease the speed of transfer of a group, as well as to hold at least one group in the buffer in the event of an error), and a plurality of buffer sensors 244*a-n* configured to detect the presence of a group as it enters the respective buffer 242*a-n*. Although not illustrated, it will be appreciated that the folding and buffering module 50 may include a folding unit configured before or after the accumulator 240.

Moreover, FIG. 7 illustrates that the uptake module 60 may include at least one collection element 246 configured with at least one pocket (not shown) to receive a document and/or a group of documents from the folding and buffering module 50. The document and/or group of documents may then proceed on the collection element 246 through that uptake module 60 to the stuffing module 70. In some embodiments, the uptake module 60 is configured to provide one or more inserts from respective insertion elements 248*a-m* to the pockets of the collection element 246. Specifically, the pockets of the collection element 246 may be configured to not only receive a document and/or group of documents from the folding and buffering module 50, but also be configured to receive at least one insert from one or more respective insertion elements 248*a-m*. The uptake module 60 may be further configured with at least one stuffing module sensor 250 to detect the presence of a document and/or group of documents from the folding and buffering module 50. In some embodiments, the collection element 246 may include a chain and/or conveyor (not shown) configured to support the at least one pocket and thus the document, group of documents, and/or insert(s) as that pocket proceeds through the uptake module 60. In those embodiments, the collection element 246 may be controlled by one or more motors (not shown).

Figure 8:
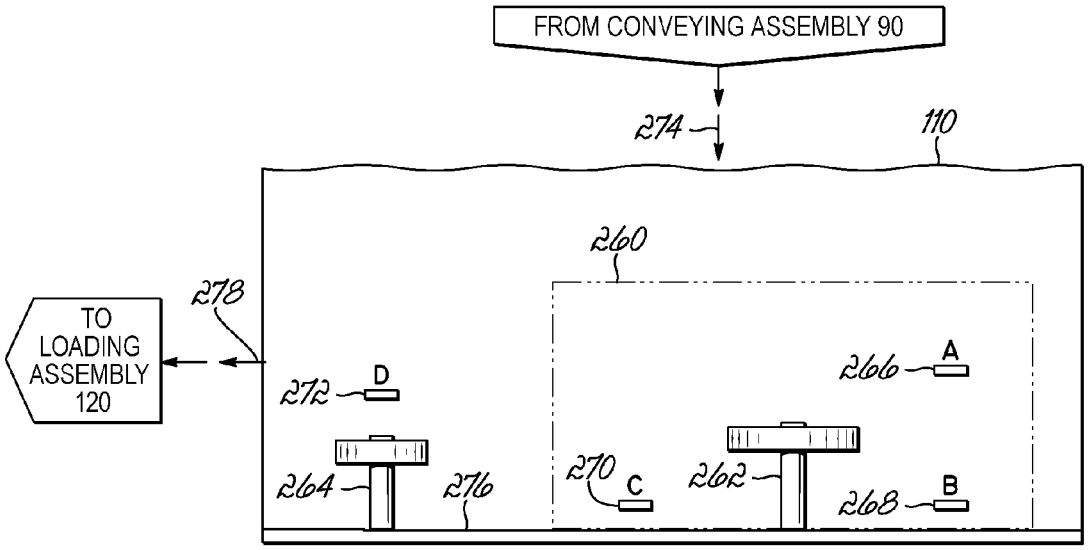
FIG. 8 is a perspective illustration of a portion of an orientation unit of the converter of FIGS. 1-2.

With reference to FIG. 8, and also for example, a portion of an orientation unit 110 for receiving at least one stuffed or filled envelope 260 from the conveying assembly 90 and re-orienting the direction of those envelopes to the loading conveyor 120 is diagrammatically illustrated. Specifically, the illustrated portion of the orientation unit 110 may include at least one directional roller 262, at least one exit roller 264, and a plurality of sensors 266-272. Specifically, the orientation unit 110 may include sensor 266 (hereinafter, sensor "A") for the detection of an envelope from the conveying assembly 90, sensors 268 and 270 (hereinafter, sensors "B" and "C," respectively) for the detection of skew, bounce, or delay for respective portions of the envelope 260, and/or sensor 272 (hereinafter, sensor "C") for the detection of the exit of the envelope 260 to the loading conveyor 120. In specific embodiments, sensors A-D are photocells that detect the presence of an envelope 260 and are monitored at approximately 10 KHz.

As illustrated in FIG. 8, the conveying assembly 90 conveys the envelope 260 in machine direction 274 into the orientation unit 110. The envelope 260 then contacts a surface 276 of the orientation unit 110 and is conveyed by the directional roller 262 in machine direction 278 toward the exit roller 264, which in turn conveys the envelope 260 toward the loading conveyor 120. As such, the orientation unit 110 may be a "ninety-degree turn" unit. In exemplary operation, the envelope 260 will contact the surface 276 at about the same time that the directional roller 262 is actuated to convey the envelope 260 along machine direction 278, and exit roller 264 will be actuated shortly after that. Thus, sensor A will sense the approach of the envelope 260, sensors B and C will also sense the envelope, and sensor D will sense the envelope at the exit roller 264. In all, FIG. 8 illustrates an exemplary operation to re-orient the machine direction of the envelope 260 from machine direction 274 to machine direction 278.

Figure 9A:
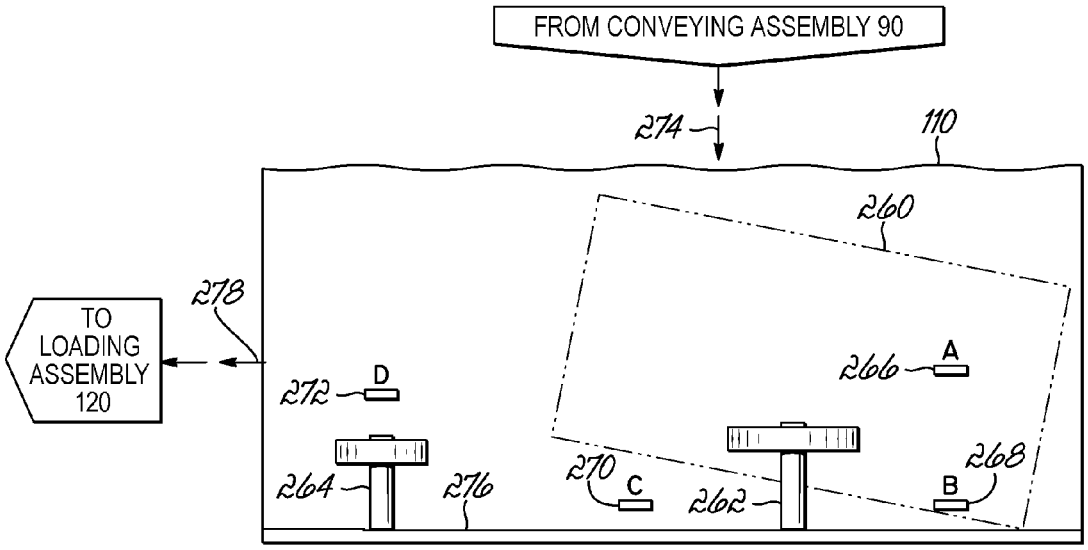
FIG. 9A is a perspective illustration of a portion of the orientation unit of FIG. 8 in which an envelope is subject to right skew.

With reference to FIG. 9A, and also for example, a portion of the orientation unit 110 in which an envelope 260 is subject to rightward skew (e.g., relative to the orientation of the envelope 260 as illustrated) is diagrammatically illustrated. Specifically, at least a portion of the envelope 260 may either never be sensed by sensor C or may bounce in front of sensor C while still being sensed for an acceptable period of time by sensor B before the directional roller 262 is actuated. For example, and with reference to FIG. 9B, two traces of the signals 280, 282 from sensors B and C that may be sensed when an envelope 260 is subject to rightward skew are diagrammatically illustrated. With reference to traces 280, when there is a bounce of a portion of the envelope 260, sensor B may sense a portion of the envelope 260 for an acceptable period of time, while sensor C only senses a portion of the envelope 260 for a very short period of time before the directional roller 262 is actuated. With reference to traces 282, sensor C may never sense the portion of the envelope 260 while sensor B senses a portion of the envelope 260 for an acceptable period of time before the directional roller 262 is actuated.

Figure 10B:
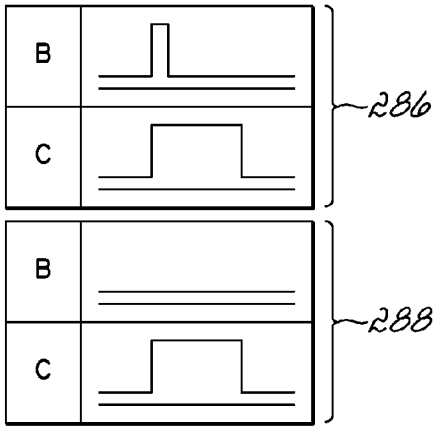
FIG. 10B is a diagrammatic illustration of sensor traces from at least a portion of the sensors configured in the orientation unit of FIG. 8 that illustrate signals that may indicate left skew.
Figure 10A:
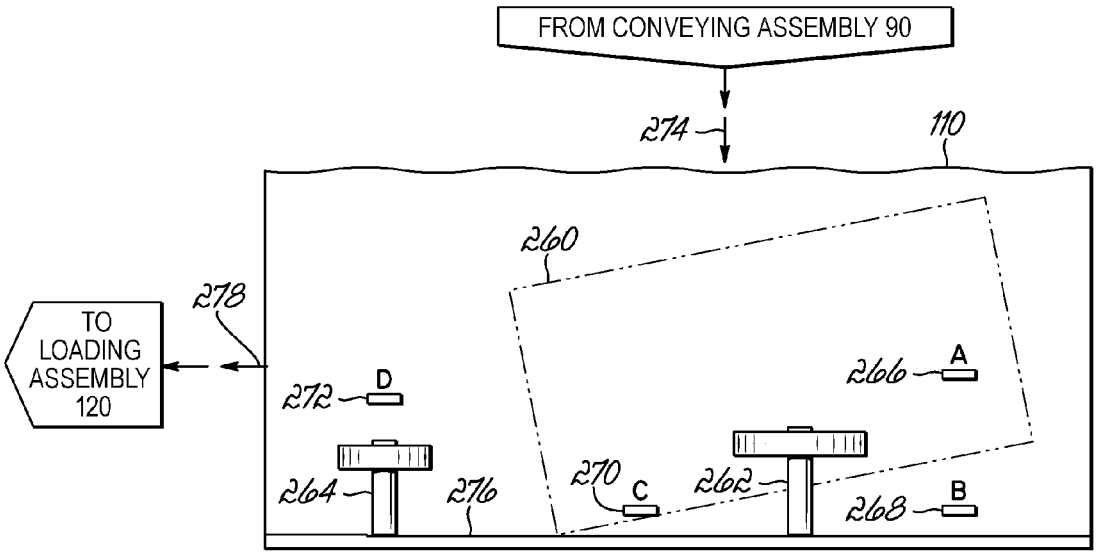
FIG. 10A is a perspective illustration of a portion of the orientation unit of FIG. 8 in which an envelope is subject to left skew.

With reference to FIG. 10A, and also for example, a portion of the orientation unit 110 in which an envelope 260 is subject to leftward skew (e.g., relative to the orientation of envelope 260 as illustrated) is diagrammatically illustrated. Specifically, at least a portion of the envelope 260 may either never be sensed by sensor B or may bounce in front of sensor B while still being sensed for an acceptable period of time by sensor C before the directional roller 262 is actuated. For example, and with reference to FIG. 10B, two traces of the signals 286, 288 from sensors B and C that may be sensed when an envelope 260 is subject to leftward skew are diagrammatically illustrated. With reference to traces 286, when there is a bounce of a portion of the envelope 260, sensor C may sense a portion of the envelope 260 for an acceptable period of time, while sensor B only senses a portion of the envelope 260 for a very short period of time before the directional roller 262 is actuated. With reference to traces 288, sensor B may never sense the portion of the envelope 260 while sensor C senses a portion of the envelope 260 for an acceptable period of time before the directional roller 262 is actuated.

Figure 11B:
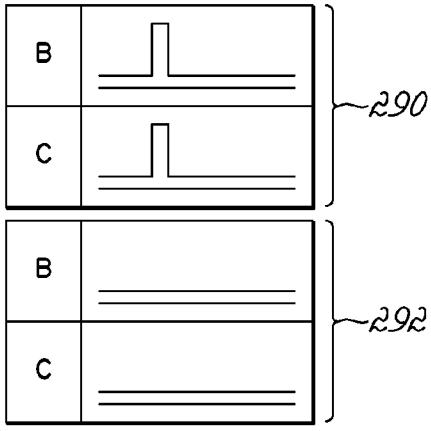
FIG. 11B is a diagrammatic illustration of sensor signals from at least a portion of the sensors configured in the orientation unit of FIG. 8 that illustrate signals that indicate clean bounce and clean delay.
Figure 11A:
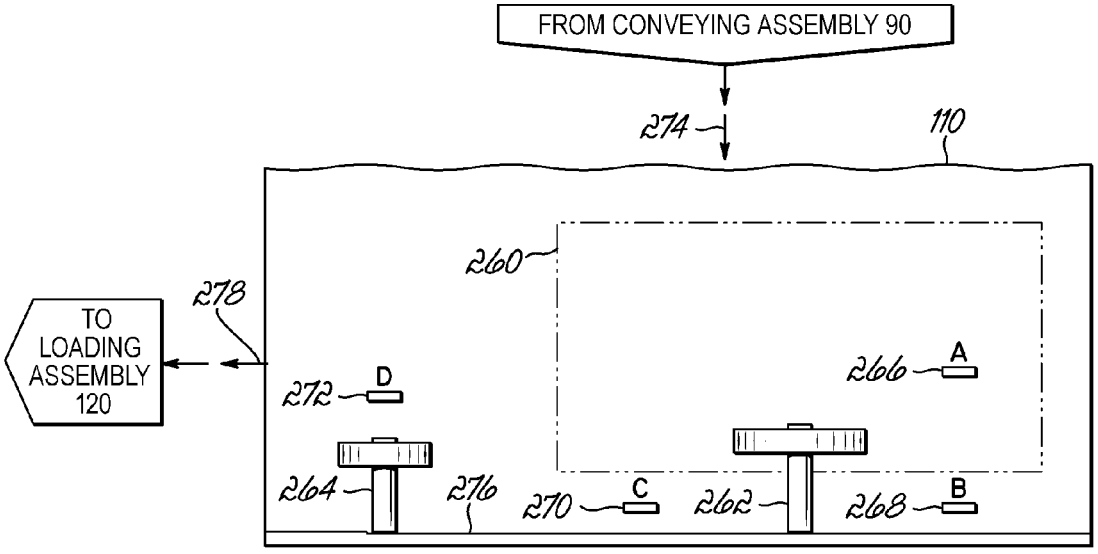
FIG. 11A is a perspective illustration of a portion of the orientation unit of FIG. 8 in which an envelope is subject to clean bounce or clean delay.

With reference to FIG. 11A, and also for example, a portion of the orientation unit 110 in which an envelope 260 is subject to a delay in contacting the surface 276 of the orientation unit 110, or a bounce of the envelope 260 relative to the surface 276 of the orientation unit 110, is diagrammatically illustrated. Specifically, the envelope 260 may either never be sensed by sensors B and C before the directional roller 262 is actuated in the case of a "clean" delay, or may be momentarily sensed by both sensors B and C before the directional roller 262 is actuated in the case of a "clean" bounce. For example, and with reference to FIG. 11B, two traces of the signals 290, 292 from sensors B and C that may be sensed when an envelope 260 is subject to either a clean bounce in the case of traces 290 or a clean delay in the case of traces 292. With reference to traces 290, when there is a clean bounce of the envelope 260 sensors B and C may sense a portion of the envelope for a short period of time before the directional roller 262 is actuated, but not for an acceptable period of time. With reference to traces 292, when there is a clean delay of the envelope 260 sensors B and C may not sense the envelope at all before the directional roller 262 is actuated. In the scenario illustrated in FIG. 11A, sensor A may have sensed a portion of the envelope before the directional roller 262 is actuated, and sensor D may sense a portion of the envelope 260 within an acceptable window of time. In that scenario, it may be determined that there is no jam of the converter 10.

Figure 12:
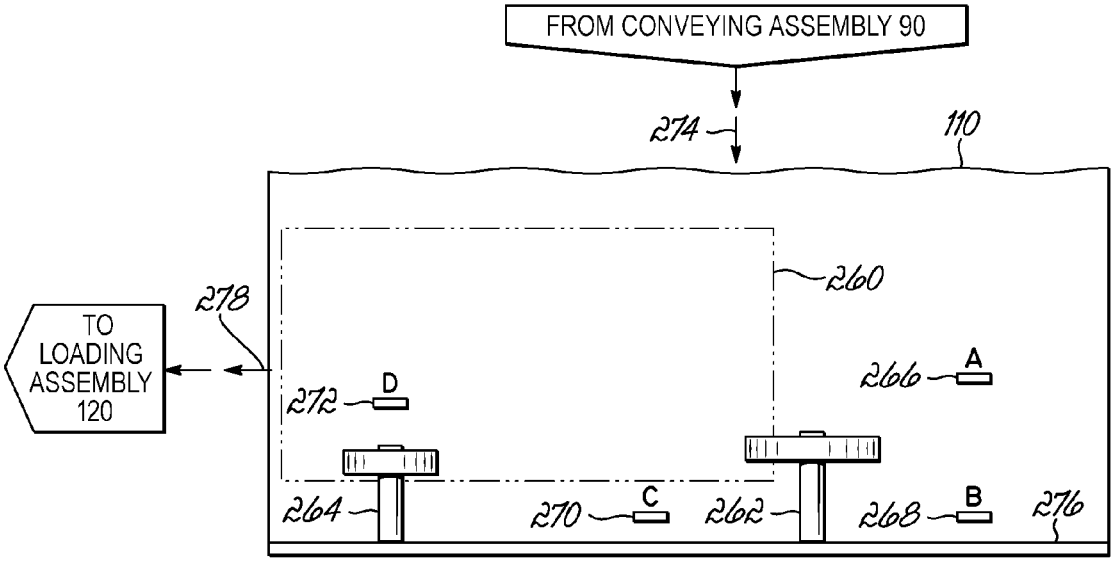
FIG. 12 is a perspective illustration of a portion of the orientation unit of FIG. 8 in which an envelope is not sensed by all the sensors configured in that orientation unit.

With reference to FIG. 12, and also for example, a portion of the orientation unit 110 in which at least a portion of an envelope 260 is subject to a skew, bounce and/or delay and that is otherwise not sensed by sensor A is diagrammatically illustrated. Specifically, this scenario illustrates that an error may be declared since the envelope 260 was not sensed by sensor A.

Those skilled in the art will recognize that the environments illustrated in FIGS. 1-12 are not intended to limit embodiments of the invention. In particular, while the converter 10 is illustrated in various embodiments as including a cutting module 30, a conveying module 40, a folding and buffering module 50, an uptake module 60, a stuffing module 70, an envelope conveyor 80, a conveying assembly 90, an orientation unit 110, a loading conveyor 120, at least one diverter 130 and/or a gantry 140, in alternative embodiments the converter 10 may include fewer or additional components and modules than those illustrated. Indeed, those having skill in the art will recognize that other alternative converters 10 may be used without departing from the scope of the invention.

Additionally, those having skill in the art will recognize that display screen 220 illustrated in FIG. 6 is also not intended to limit embodiments of the invention. For example, the display screen 220 may include more or fewer panes 222-226, display representations of buttons and/or information than illustrated. Moreover, and as discussed, the user may interact with the display screen 220 or a portion thereof to view information particular to a user interaction. For example, if the user chooses, from the display representation of the converter 222, a particular component, it will be understood that information associated with that particular component may be displayed in the interactive information pane 224 and/or the interactive control pane 226. Also for example, the user may interact with additional display representations of control buttons (e.g., for example, "Control On," "Single Step Mode," "Next," etc.) to access additional control options to control the converter 10 (e.g., respectively, turn individual control of modules on, turn single-step control one, view more control options etc.), as well as interact with additional display representations of information buttons (e.g., for example, the display representation of the button "Info," "Event Log," "Pneumatics," etc.) to access additional information respective to those buttons (e.g., respectively, additional information about the current converter and jobs, an event log of the converter 10, information about the pneumatics of the converter 10, etc.)

Furthermore, the while the computing system 150 includes a number of components and the converter control module 168 includes a number of interfaces, one having ordinary skill in the art will appreciate that alternative hardware and/or software environments may be used without departing from the scope of the invention. For example, a virtual converter interface, an EtherCAT® communications interface, etc., may be included within or separate from the converter control module 168 without departing from the scope of the invention. As such, other alternative hardware and/or software environments may be used without departing from the scope of the invention.

Figure 9B:
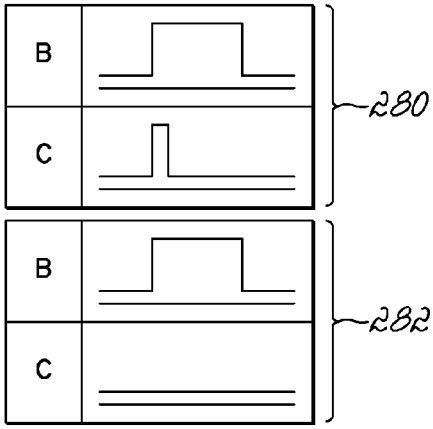
FIG. 9B is a diagrammatic illustration of sensor traces from at least a portion of the sensors configured in the orientation unit of FIG. 8 that illustrate signals that may indicate right skew.

For example, it will be appreciated by one having ordinary sill in the art that FIG. 7 is merely illustrative of a portion of a folding and buffering module 50 as well as a portion of an uptake module 60 of the converter 10. As such, the folding and buffering module 50 and/or uptake module 60 may include more or fewer components than those illustrated, and in some embodiments may include additional components than those illustrated. Moreover, and also for example, it will be appreciated by one having ordinary skill in the art that FIGS. 8, 9A, 10A, 11A and 12 are merely illustrative of a portion of the converter 10 and utilized to provide an example of various scenarios in an orientation unit 110. The specific orientation and number of sensors 266-272, the specific machine directions 274, 278, and the specific orientation, direction and number of rollers 262-264 are not intended to be limiting. Furthermore, it will be appreciated by one having ordinary skill in the art that FIGS. 9B, 10B, and 11B are merely exemplary signals that may be provided to the computing system 150 from sensors B and C, and are not intended to be limiting.

The routines executed to implement the embodiments of the invention, whether implemented as part of an operating system or a specific application, component, program, object, module or sequence of operations executed by the processing unit(s) or CPU(s) will be referred to herein as "computer program code," or simply "program code." The program code typically comprises one or more instructions that are resident at various times in various memory and storage devices in the converter 10 and/or computing system 150 and that, when read and executed by one or more processing units or CPUs of the converter 10 and/or computing system 150, cause that converter 10 and/or computing system 150 to perform the steps necessary to execute steps, elements, and/or blocks embodying the various aspects of the invention.

While the invention has and hereinafter will be described in the context of fully functioning documentation and communication systems as well as computing systems, those skilled in the art will appreciate that the various embodiments of the invention are capable of being distributed as a program product in a variety of forms, and that the invention applies equally regardless of the particular type of computer readable signal bearing media used to actually carry out the distribution. Examples of computer readable signal bearing media include but are not limited to recordable type media such as volatile and nonvolatile memory devices, floppy and other removable disks, hard disk drives, optical disks (e.g., CD-ROM's, DVD's, etc.), among others, and transmission type media such as digital and analog communication links.

In addition, various program code described hereinafter may be identified based upon the application or software component within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into sequences of operations, routines, procedures, methods, modules, objects, and the like, as well as the various manners in which program functionality may be allocated among various software layers that are resident within a typical computer (e.g., operating systems, libraries, APIs, applications, applets, etc.), it should be appreciated that the invention is not limited to the specific organization and allocation of program functionality described herein.

Figure 13:
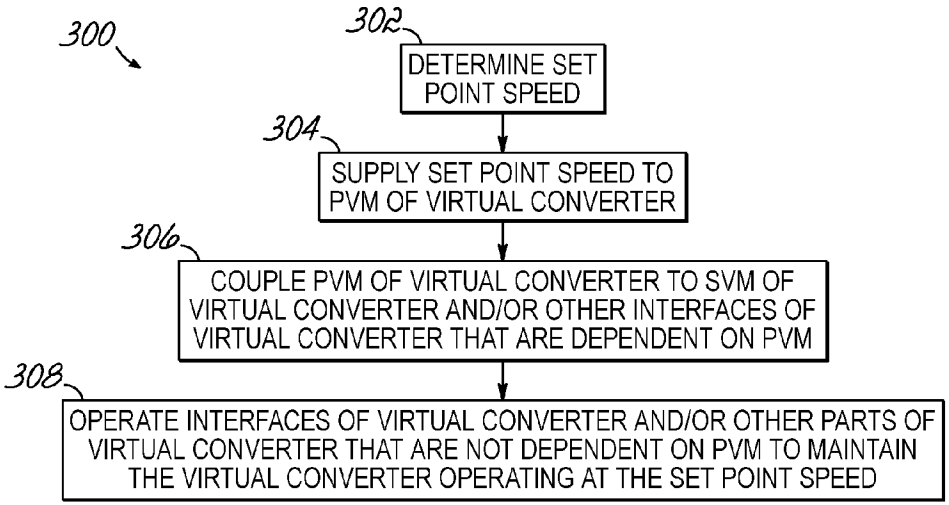
FIG. 13 is a flowchart illustrating a sequence of operations that may be executed by the central controller of FIG. 3 to initialize operation of a virtual converter.

FIG. 13 is a flowchart illustrating a sequence of operations 300 that may be executed by a computing system to initialize the operation of a virtual converter consistent with embodiments of the invention. Specifically, the sequence of operations 300 may be performed by a converter control module of the computing system. As such, the set point speed for the virtual converter and the converter may be determined (block 302) and supplied to a primary virtual master (illustrated as "PVM") of the virtual converter (block 304). In some embodiments, the set point speed is determined from user input, including user input from a user interface of the computing system and/or user interaction with a display representation of a display screen provided by the converter control module. In response to supplying the set point speed to the primary virtual master, the primary virtual master may be coupled to a secondary virtual master (illustrated as "SVM") of the virtual converter and/or other interfaces of the virtual converter that are dependent on that primary virtual master (block 306). The interfaces of the virtual converter and/or other parts of the virtual converter that are not dependent on the primary virtual master may be operated to maintain the virtual converter at the set point speed (block 308). As such, the virtual converter may be operated at the set point speed.

Figure 14A:
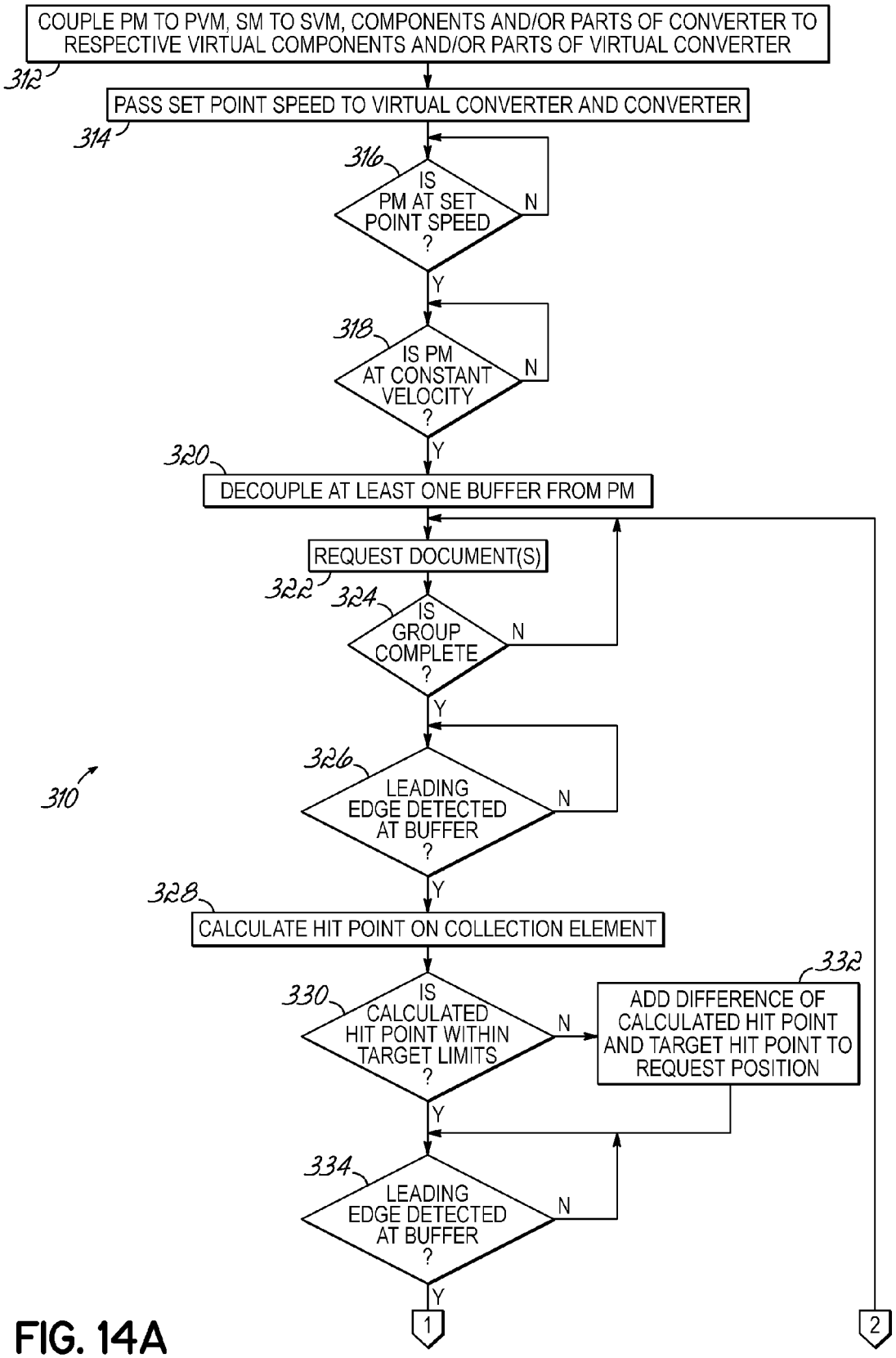
FIG. 14A and FIG. B are a flowchart illustrating a sequence of operations that may be executed by the central controller of FIG. 3 to control the operation of at least a portion of the converter of FIGS. 1-2.
Figure 14B:
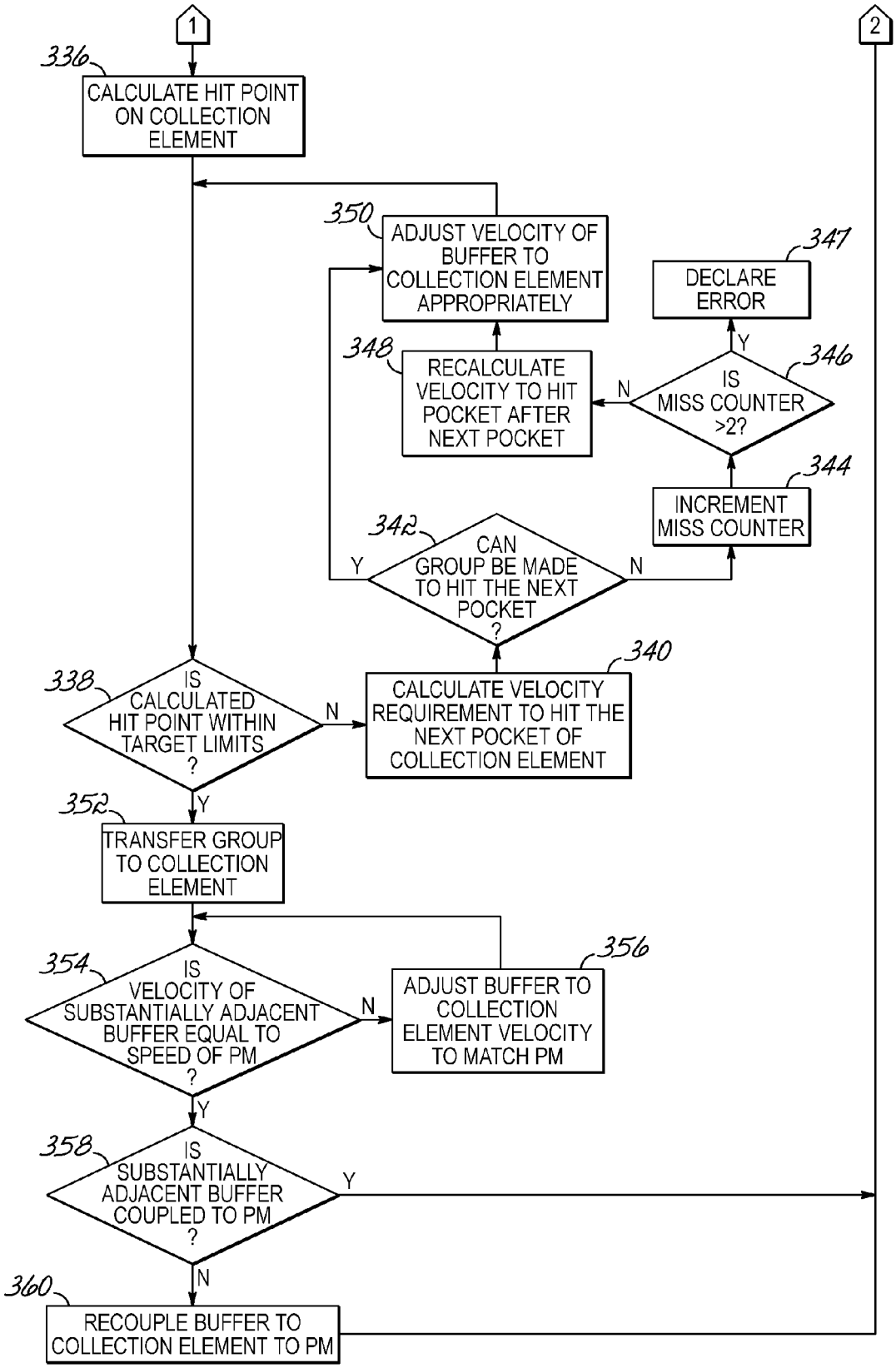

FIG. 14A and FIG. 14B are a flowchart illustrating a sequence of operations 310 that may be executed by the computing system to operate at least a portion of the converter consistent with embodiments of the invention. The sequence of operations may begin by coupling the primary virtual master of the virtual converter to its respective component and/or part of the converter (e.g., the "primary master" of the converter, illustrated as "PM"), coupling the secondary virtual master of the virtual converter to its respective component and/or part of the converter (e.g., the "secondary master" of the converter, illustrated as "SM"), and/or coupling other virtual components and/or virtual parts of the virtual converter to their respective components and/or parts of the converter (block 312). The set point speed may then be passed to the virtual converter and the converter (block 314) in a similar manner as that illustrated in FIG. 13.

Returning to FIG. 14A and FIG. 14B, as the primary master, secondary master, and/or components and/or parts of the converter are coupled to the respective primary virtual master, secondary virtual master, and/or virtual components and/or parts of the virtual converter, the converter may begin operating and attempt to reach the set point speed. After the set point speed has been passed to the virtual converter and the converter, it may be determined whether the primary master has reached the set point speed (block 316). When the primary master has not reached the set point speed ("No" branch of decision block 316) it may be again determined whether the set point speed has been reached (block 316). When the primary master reaches the set point speed ("Yes" branch of decision block 316) it may be determined whether the primary master has reached a constant velocity of the set point speed (block 318). In specific embodiments, it may be determined that the primary master has reached a constant velocity of the set point speed when the primary master maintains the set point speed for a period of time, such as, for example, about two seconds. When the primary master has not reached a constant velocity of the set point speed ("No" branch of decision block 318) it may be again determined whether a constant velocity of the set point speed has been reached (block 318). When the primary master has reached a constant velocity of the set point speed ("Yes" branch of decision block 318) the sequence of operations may decouple at least one buffer from the primary master (block 320).

By decoupling at least one buffer from the primary master, and specifically the buffer substantially adjacent to the at least one accumulator (e.g., as illustrated in FIG. 7, "Buffer 1"), the sequence of operations may prepare that buffer to accept at least one document or group of documents from that accumulator. It may be advantageous to decouple the buffer from the primary master to match the speed of a document or group of documents being provided to the buffer, which may be limited by the speed of an upstream component, such as an accumulator and/or another part or component of the converter. Thus, a document or documents may be requested (block 322).

In response to requesting a document, it may be determined whether a group associated with that document is complete (block 324). When the group is not complete ("No" branch of decision block 324) additional documents may be requested for that group (block 322). When the group is complete ("Yes" branch of decision block 324) the group may proceed to the buffer substantially adjacent to the at least one accumulator and it may be determined whether the leading edge of that group is detected at that buffer (block 326). When the leading edge of the group is not detected at the buffer substantially adjacent to the at least one accumulator ("No" branch of decision block 326) it may be again determined whether the leading edge of the group is detected at that buffer (block 326). When the leading edge of the group is detected at the buffer substantially adjacent to the at least one accumulator ("Yes" branch of decision block 326) the location at which that group will be passed off to a collection element of an uptake module of the converter at the current speed (e.g., the "hit point" being the location at which the group will "hit" the collection element) is determined (block 328). Specifically, it may be determined whether the group will hit a pocket of the collection element.

In response to determining the hit point of the collection element, it may be determined whether the location at which the group will be passed off to the collection element is within a target limit for passing the group off to the collection element (e.g., whether the hit point is a pocket or other acceptable portion of the collection element such that the group will proceed to that pocket, or whether the hit point will miss a pocket of the collection element) (block 330). When the hit point is not within the target limits ("No" branch of decision block 330) the difference between the calculated location at which the group will be passed off to the collection element and the next desired location at which a group could be passed off to the collection element (e.g., the difference between the current hit point and the target hit point of the next pocket of the collection element) may be determined, and that value may be used to determine when to make the next request (block 332). In specific embodiments, the difference may include a determination of the rotational location of the collection element and/or a motor thereof.

When the hit point is within the target limits ("Yes" branch of decision block 33) or after correcting the location at which to make the next correction (block 332) it may be determined whether the leading edge of the group is detected at the buffer substantially adjacent to the collection element (block 334), which may be the same buffer as the buffer substantially adjacent to the at least one accumulator. When the leading edge of the group is not detected at the buffer substantially adjacent to the collection element ("No" branch of decision block 334) it may be again determined whether the leading edge of the group is detected at that buffer (block 334). When the leading edge of the group is detected at the buffer substantially adjacent to the collection element ("Yes" branch of decision block 334) the location at which that group will be passed off to the collection element of the converter at the current speed (e.g., the "hit point" being the location at which the group will "hit" the collection element) is again determined (block 336). In response to re-determining the hit point, it may be again determined whether the location at which the group will be passed off to the collection element is within a target limit for passing the group off to the collection element (block 338).

When the hit point is not within the target limits ("No" branch of decision block 338) a change in the velocity for the buffer substantially adjacent to the collection element to hit the next pocket may be determined (block 340). Specifically, it may be determined whether that buffer must be sped up or slowed down to hit the next pocket, and what the increased or decreased rate of speed should be. As such, it may be determined whether it is possible for the group to hit the next pocket with the adjustments determined in block 340 (block 342). The determination of whether it is possible for the group to hit the next pocket may be made with reference to additional groups before and/or after the current group detected at the buffer substantially adjacent to the collection element, the maximum speed of the buffer substantially adjacent to the collection element, the minimum speed of the buffer substantially adjacent to the collection element, and/or the current location of at least one next pocket of the collection element. As such, when it is determined that it is not possible for the group to hit the next pocket ("No" branch of decision block 342), a miss counter is incremented (block 344) and it is determined whether the miss counter is greater than two (block 346). When the miss counter is greater than two ("Yes" branch of decision block 346) an error is declared (block 348). When the miss counter is not greater than two ("No" branch of decision block 346) a change in the velocity for the buffer substantially adjacent to the collection element to hit the pocket after the next pocket may be determined (block 348). After determining that it is possible for the group to hit the next pocket ("Yes" branch of decision block 342) or after calculating the change in velocity for the buffer substantially adjacent to the collection element to hit the pocket after the next pocket (block 348), the velocity of the buffer substantially adjacent to the collection element may be adjusted accordingly (block 350). In response to adjusting the velocity of the buffer substantially adjacent to the collection element, the sequence of operations may return to block 338.

Returning to block 338, when the hit point is within the target limits ("Yes" branch of decision block 338) the sequence of operations may wait for the group to be transferred to the collection element (block 352) then determine if the velocity of the buffer substantially adjacent to the collection element is equal to the speed of the primary master (block 354). When the velocity of that buffer is not equal to the speed of the primary master ("No" branch of decision block 354) the velocity of the buffer may be adjusted to match the velocity of the primary master (block 356) and it may be again determined whether the speed of the buffer substantially adjacent to the collection element is equal to the speed of the primary master. When the velocity of the buffer closes to the collection element is equal to the speed of the primary master ("Yes" branch of decision block 354) it may be determined whether that buffer is coupled to the primary master (block 358). When the buffer substantially adjacent to the collection element is not coupled to the primary master ("No" branch of decision block 358) that buffer may be re-coupled to the primary master (block 360). In response to determining that the buffer substantially adjacent to the collection element is coupled to the primary master ("Yes" branch of decision block 358) or in response to re-coupling that buffer to the primary master (block 360) the sequence of operations may again request a document or documents (block 322).

With reference to FIGS. 14A and 14B, it will be appreciated that a stack or group may include one or more documents, and thus the term "group" is not intended to be limited to a plurality of documents. Moreover, it will be appreciated that blocks 334-338 may be omitted if there is one buffer between the at least one accumulator and the collection element. As such, and in alternative embodiments, the sequence of operations may proceed from block 332 to block 340 without departing from the scope of the invention. Furthermore, and as illustrated in FIG. 14A and FIG. 14B, when to request a document may be dependent on not only the movement of a document or group of documents, but also based on the rotational location of the collection element and/or a motor thereof.

Figure 15:
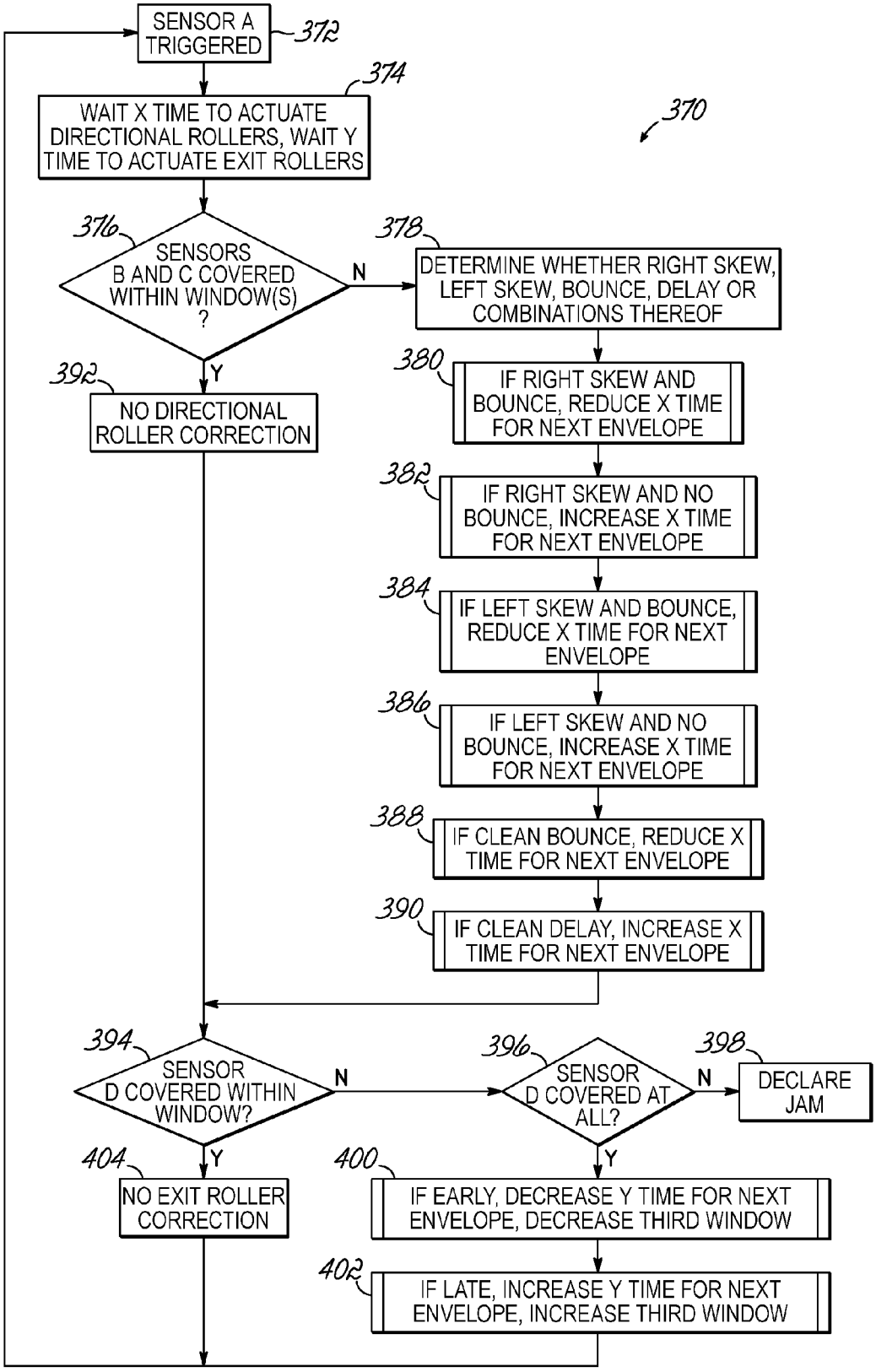
FIG. 15 is a flowchart illustrating a sequence of operations that may be executed by the central controller of FIG. 3 to determine a correction to at least a portion of the orientation unit of FIG. 8 to correct skew, delay, bounce and/or combinations thereof.

FIG. 15 is a flowchart illustrating a sequence of operations 370 that may be executed by the computing system to determine a correction to at least one directional roller and/or at least one exit roller of a portion of an orientation unit of a converter consistent with embodiments of the invention, and in specific embodiments the portion of the orientation unit of a converter illustrated in FIGS. 8-12. Specifically, a first sensor (e.g., sensor A) may sense at least a portion of an envelope (e.g., sensor A is "triggered") (block 372). In response, the sequence of operations may wait for a first period of time (e.g., "X" time) to actuate at least one directional roller and wait for a second period of time (e.g., "Y" time) to actuate at least one exit roller (block 374). The first period of time may be a period of time configured to be long enough to allow the envelope to contact a surface of the orientation unit but not long enough for the envelope to bounce, while the second period of time may be a period of time configured to actuate the exit roller just before the envelope reaches the exit roller.

The sequence of operations may then determine whether a second and a third sensors (e.g., sensors B and C, respectively) that may be used to detect skew, bounce and/or delay detected at least a portion of an envelope (e.g., were "covered") within a first window of time for at least a second window of time (block 376). Specifically, the first window of time may be a window of time after the first sensor has sensed the at least a portion of an envelope, while the second window of time may be a period of time during which the second and/or third sensors are analyzed to determine whether a respective portion of the envelope detected by the second and/or third sensor are associated with skew or delay. When the second and/or third sensor do not detect respective portions of the envelope within the first and/or second windows ("No" branch of decision block 376), it may be determined whether at least one portion of the envelope was subject to skew, a bounce and/or a delay (block 378). In specific embodiments, data associated with the envelope detected by the second and third sensors is analyzed to determine whether an envelope was subject to right skew with bounce, right skew with delay, left skew with bounce, left skew with delay, a clean bounce or a clean delay. When the envelope is subject to right skew with bounce (e.g., such as illustrated in FIG. 8A and traces 260 of FIG. 8B) the first time may be reduced for the next envelope (block 380). The reduction of the first time may decrease the amount of time to actuate the at least one directional roller and prevent the envelope from suffering right skew with bounce. When the envelope is subject to right skew with delay (e.g., such as illustrated in FIG. 8A and traces 262 of FIG. 8B) the first time may be increased for the next envelope (block 382). The increase of the first time may increase the amount of time to actuate the at least one directional roller and prevent the envelope from suffering right skew with delay. When the envelope is subject to left skew with bounce (e.g., such as illustrated in FIG. 9A and traces 270 of FIG. 9B) the first time may be reduced for the next envelope (block 384). The reduction of the first time may decrease the amount of time to actuate the at least one directional roller and prevent the envelope from suffering left skew with bounce. When the envelope is subject to left skew with delay (e.g., such as illustrated in FIG. 9A and traces 272 of FIG. 9B) the first time may be increased for the next envelope (block 386). The increase of the first time may increase the amount of time to actuate the at least one directional roller and prevent the envelope from suffering left skew with delay.

In addition to determining skew with bounce and/or delay, a clean bounce and/or a clean delay in which the second and third sensor do not detect respective portions of the envelope within the first and/or second windows may also be determined. When the envelope is subject to a clean bounce (e.g., such as illustrated in FIG. 10A and traces 280 of FIG. 10B) the first time may be decreased for the next envelope (block 388). The decrease of the first time may decrease the amount of time to actuate the at least one directional roller, thus decreasing the amount of time for the envelope to reach the surface of the orientation unit and, it is believed, advantageously allowing a better transfer of the envelope to the at least one exit roller. When the envelope is subject to a clean delay (e.g., such as illustrated in FIG. 10A and more particularly traces 282 of FIG. 10B) the first time may be increase for the next envelope (block 390). The increase of the first time may increase the amount of time to actuate that at least one directional roller, thus increasing the amount of time for the envelope to reach the surface of the orientation unit and, it is believed, advantageously allowing a better transfer of the envelope to the at least one exit roller.

When the second and third sensor detect respective portions of the envelope within the first and second windows ("Yes" branch of decision block 376), there is no correction of the first time to actuate the at least one directional roller (block 392). In response to correcting skew, delay, bounce and/or combinations thereof (blocks 380-390), as well as in response to determining that no directional roller correction is necessary (block 392), the sequence of operations may determine whether a fourth sensor (e.g., sensor D) that may be used to detect the presence of at least a portion of the envelope at the at least one exit roller actually detects that at least a portion of the envelope (e.g., sensor D is "covered") within a third window of time (block 394). Specifically, the third window of time may be a period of time during which the fourth sensor is analyzed to determine whether a respective portion of the envelope is detected by the fourth sensor. When the fourth sensor does not detect the at least a portion of the envelope within the third window ("No" branch of decision block 394), the sequence of operations may determine if the fourth sensor detected that at least a portion of the envelope at all (e.g., whether the fourth sensor detected the at least a portion of the envelope early or late) (block 396). When the fourth sensor does not detect the at least a portion of the envelope at all ("No" branch of decision block 396) a jam and/or an error may be declared (block 398). When the fourth sensor does detect the at least a portion of the envelope early or late ("Yes" branch of decision block 396), the second time may be adjusted. Specifically, if the envelope is detected before the third window (e.g., the envelope is detected early) the second time for the at least one exit roller to be actuated may be decreased for the next envelope (block 400). Correspondingly, if the envelope is detected after the third window (e.g., the envelope is detected late) the second time for the at least one exit roller to be actuated may be increased for the next envelope (block 402). Returning to block 394, when the fourth sensor detects the at least a portion of the envelope within the third window ("Yes" branch of decision block 394), there is no correction of the second time to actuate the at least one exit roller (block 404).

Figure 16:
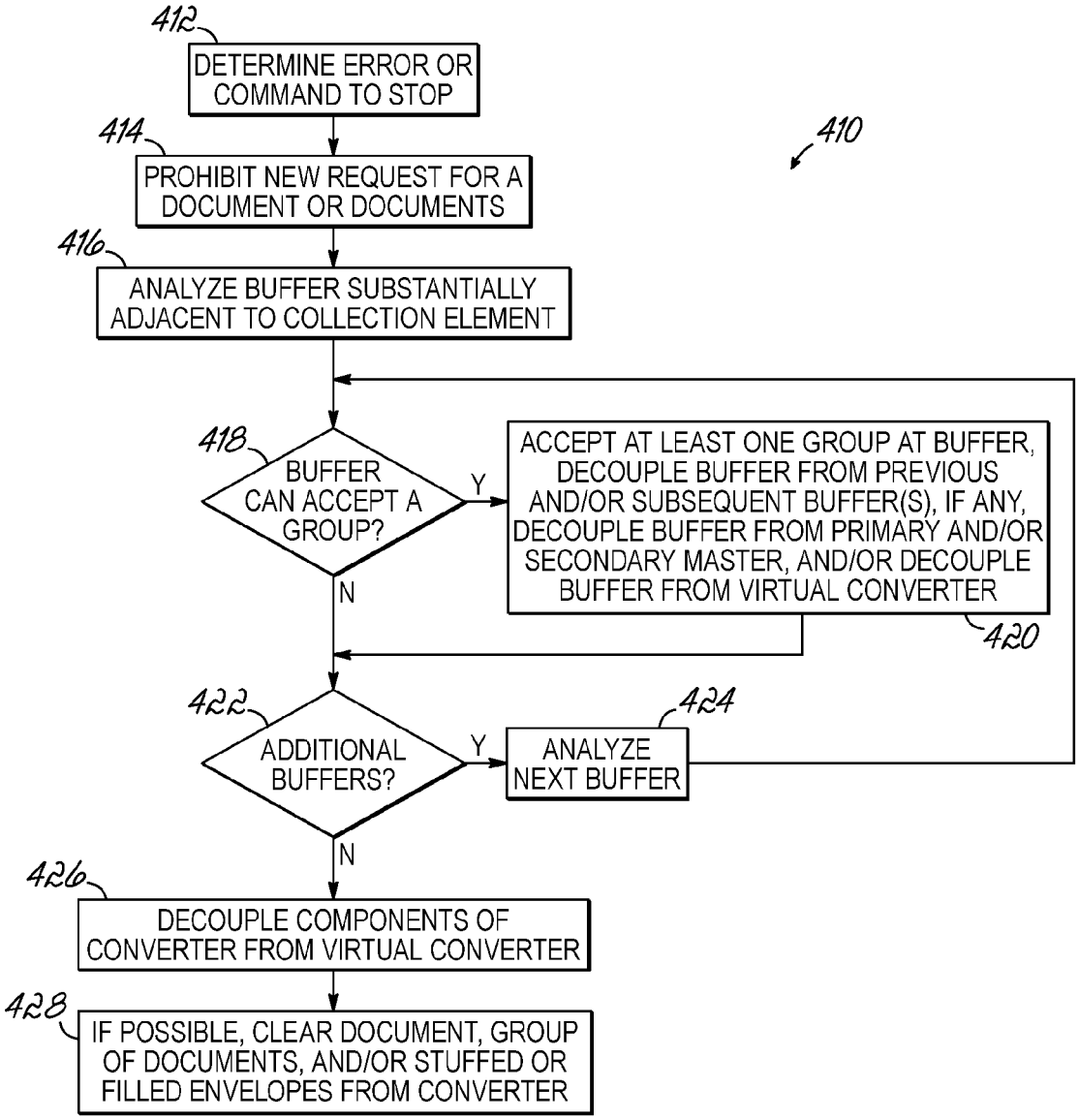
FIG. 16 is a flowchart illustrating a sequence of operations that may be executed by the central controller of FIG. 3 to stop the converter of FIGS. 1-2.

FIG. 16 is a flowchart illustrating a sequence of operations 410 that may be executed by the computing system to stop a converter consistent with embodiments of the invention. In particular, it may be determined that an error has been declared or that a user has issued a command for the operation of the converter to stop (e.g., for example, an emergency stop command) (block 412). As such, any new request for a document or group of documents may be prohibited (block 414) and the buffer substantially adjacent to the collection element may be analyzed (block 416). Specifically, it may be determined whether that buffer can accept at least one group of documents (block 418). When the buffer substantially adjacent to the collection element can accept at least one group of documents ("Yes" branch of decision block 418) that buffer accepts at least one group, decouples from previous and/or subsequent buffers, if any, decouples from the primary master if so coupled, and/or decouples from the virtual converter (block 420). When the buffer substantially adjacent to the collection element cannot accept at least one group of documents ("No" branch of decision block 418), or after block 420, it may be determined whether there is at least one additional buffer (block 422). In specific embodiments, the "next" buffer may be an "N−1" buffer, N being the buffer previously analyzed. When there is at least one additional buffer ("Yes" branch of decision block 422) that buffer is analyzed block 424 and the process repeats back to block 418.

When there is not at least one additional buffer ("No" branch of decision block 422) components of the converter are decoupled from the virtual converter (block 426). This may include decoupling the primary master from the primary virtual master and the secondary master from the secondary virtual master, as well as decoupling modules, components and/or parts of the converter from their respective modules, components and/or parts of the virtual converter (block 426). Subsequently, and if possible, a document, group of documents and/or a stuffed or filled envelope may be cleared from the converter (e.g., processed by the converter) (block 428). It will be appreciated that in the event of a jam or emergency stop the converter may be brought to a stop instead of attempting to process the document, group of documents and/or stuffed or filled envelope.

Figure 17:
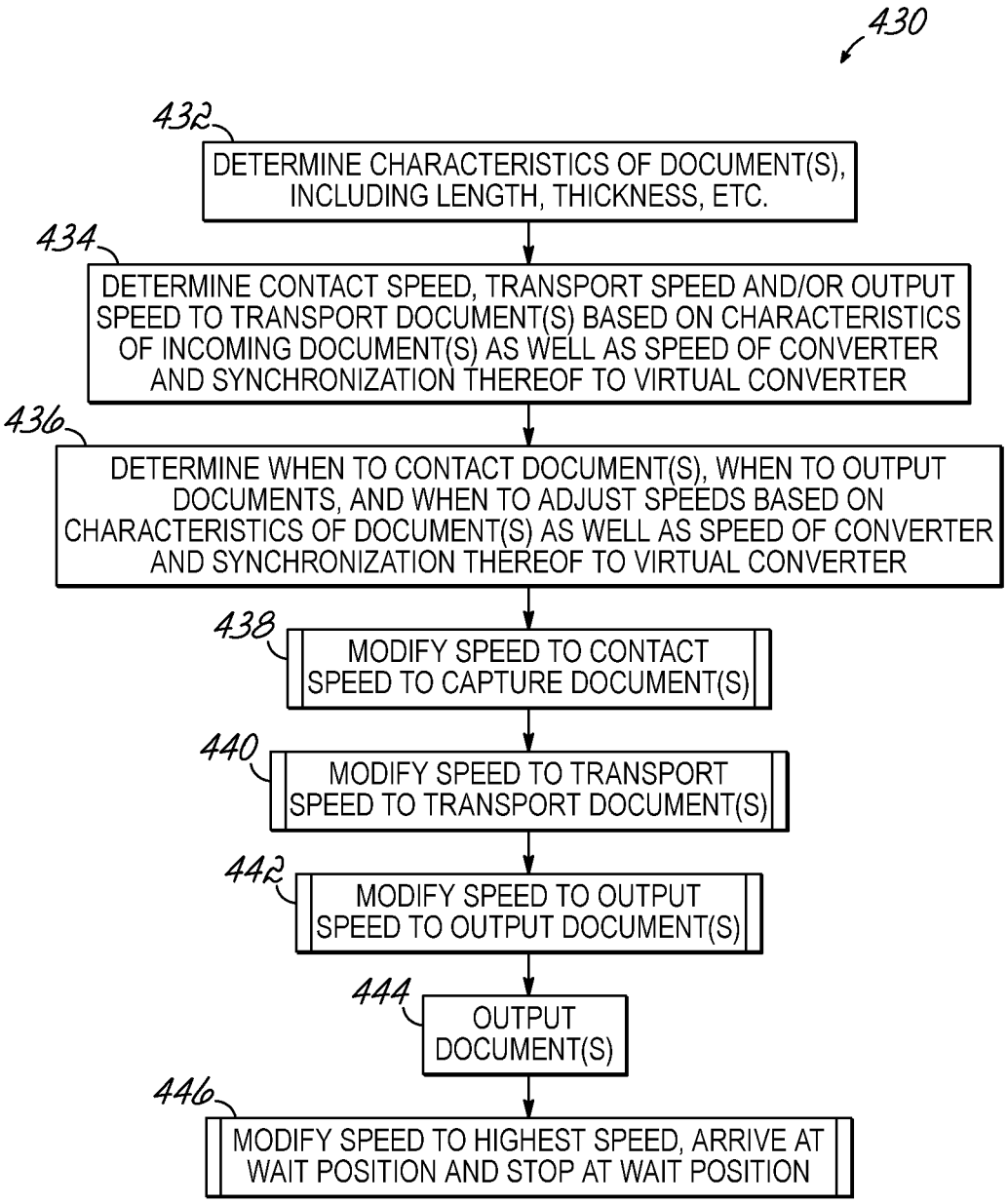
FIG. 17 is a flowchart illustrating a sequence of operations that may be executed by the central controller of FIG. 3 to determine operational characteristics of the converter of FIGS. 1-2 based upon characteristics at least one of a discrete sheet of material and a stack of sheets of material.

FIG. 17 is a flowchart illustrating a sequence of operations 430 that may be executed by the computing system to determine operational characteristics of the converter based on characteristics of a document or group of documents consistent with embodiments of the invention. Specifically, the computing system may determine the length, width, thickness, weight and/or other characteristics of the document or group of documents (e.g., "document(s)") (block 432). In some embodiments, these characteristics are determined from sensors in the converter, while in alternative embodiments these characteristics are input by a user and calculated by the computing system. The contact speed, transport speed and/or output speed to transport the document(s) may then be determined based upon those characteristics as well as the speed of the converter and the synchronization thereof to the virtual converter (block 434). Additionally, it may be determined when to contact the document(s), when to output the document(s) and when to adjust the speeds (e.g., decelerate and/or accelerate to and/or from the contact speed, transport speed and/or output speed) based upon characteristics of the document(s) as well as the speed of the converter and the synchronization thereof to the virtual converter (block 436). For example, the contact speed may be slower for document (s) having a greater weight to prevent damage to the document (s) upon contact, while the output speed may be slower for document(s) having a greater length to prevent damage upon output of the document(s). Also for example, the transport speed of first document(s) may be slower than the transport speed of second document(s), as the converter may need to "catch up" to the operation of a virtual converter, and thus increase that transport speed accordingly. Furthermore, it will be appreciated that "when" to adjust the speeds may include times to adjust the speeds (e.g., including times relative to operate the at least one roller at each respective speed as well as times relative to a clock), the locations of the document(s) at which to adjust the speeds and/or rotational axes of the at least one roller at which to adjust the speeds consistent with embodiments of the invention.

In response to determining the appropriate speeds to transport the document(s) (block 434), as well as when to adjust those speeds (block 436), the speed of at least one roller (e.g., for example, at least one roller in an accumulator or a buffer, which may be at least one directional roller and/or at least one roller configured with a capture and transport device for the document(s)) may be adjusted to the contact speed appropriately to contact the document(s) (block 438). Similarly, the speed of the at least one roller may be adjusted to the transport speed appropriately to transport the document(s) (block 440) and the speed of the at least one roller may be adjusted to the output speed appropriately to output the document(s) (block 442). Upon output of the document(s) (block 444), the speed of the at least one roller may be adjusted to the highest speed to arrive at the wait position, then stop at the wait position, for an additional document(s) (block 446).

Figure 18:
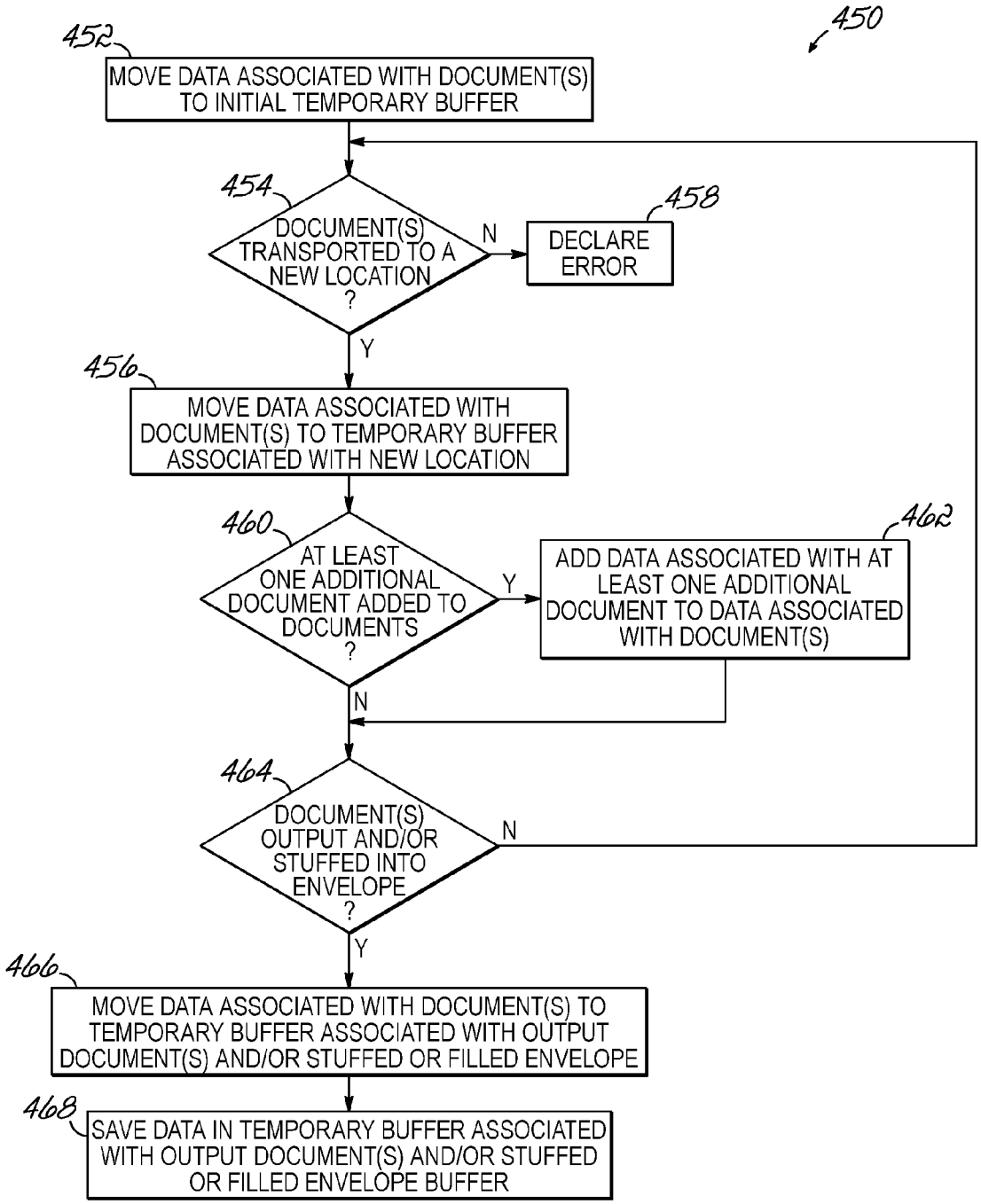
FIG. 18 is a flowchart illustrating a sequence of operations that may be executed by the central controller of FIG. 3 to track data associated with a document, group of documents and/or a stuffed or filled envelope as the document, group of documents and/or stuffed or filled envelope moves through the converter of FIGS. 1-2.

In addition to controlling the operation of the converter, the computing system, and in particular converter control module configured thereupon, may be configured to track data associated with a document, group of documents and/or a stuffed or filled envelope. FIG. 18 is a flowchart illustrating a sequence of operations 450 that may be executed by the computing system to track data associated with a document, group of documents and/or a stuffed or filled envelope as the document, group of documents and/or stuffed or filled envelope moves through the converter consistent with embodiments of the invention. Specifically, data associated with a document or group of documents (e.g., illustrated, and referred to, as "document(s)" for the sake of brevity) may be stored in the computing system and proceed through a plurality of buffers associated with respective locations, components, modules and/or parts of the converter as the document (s) proceed through those respective locations, components, modules and/or parts of the converter. Thus, data associated with the document(s) may be moved to an initial temporary buffer (block 452). Upon detection of the movement of the document(s) to a new location ("Yes" branch of decision block 454), the data associated with the document(s) may be moved to a temporary buffer associated with that new location (block 456). Alternatively, when the document(s) are not detected to move (e.g., in the event of a jam, missed sensor signal, or an emergency stop) ("No" branch of decision block 454), an error may be declared (block 458).

After moving data associated with the document(s) to the temporary buffer associated with the new location (block 456), it may be determined whether at least one additional document has been added to the document(s) (e.g., such as, for example, a new document added in a folding and buffering module or an uptake module) (block 460). When it is determined that at least one additional document has been added to the document(s) ("Yes" branch of decision block 460), data associated with that at least one additional document is added to the data associated with the document(s) (block 462). When it is determined that at least one additional document has not been added to the document(s) ("No" branch of decision block 460), or in response to adding data associated with at least one additional document to the data associated with the document(s) (block 462), it may be determined whether the document(s) has been output or placed into an envelope (block 464). When the document(s) has not been output and/or placed into an envelope ("No" branch of decision block 464), it may be again determined whether the document(s) have been transported to a new location (block 454). Alternatively, when the document(s) has been output and/or placed into an envelope ("Yes" branch of decision block 464), the data associated with the document(s) may be moved to a temporary buffer associated with the output document(s) and/or the stuffed or filled envelope (block 466). In an optional step, data in the output document(s) and/or stuffed or filled envelope buffer may be saved outside of the plurality of temporary data buffers (block 468), such as, for example, in a memory or main storage of the computing system.

In light of the foregoing, it will be appreciated that the converter may be controlled by the computing system based upon the location of a document, group of documents and/or a stuffed or filled envelope within the converter. Moreover, the converter may be controlled by the computing system based upon the width, length, thickness, weight, and/or orientation of a document, group of documents and/or stuffed or filled envelope. Additionally, the converter may be controlled by matching at least a portion of the operation of the converter to a virtual converter.

While the present invention has been illustrated by a description of the various embodiments and the examples, and while these embodiments have been described in considerable detail, it is not the intention of the applicants to restrict or in any way limit the scope of the appended claims to such detail. Additional advantages and modifications will readily appear to those skilled in the art. Thus, the invention in its broader aspects is therefore not limited to the specific details, apparatus and method shown and described. In particular, any of the blocks of the above flowcharts may be deleted, augmented, made to be simultaneous with another, combined, or be otherwise altered in accordance with the principles of the present invention. For example, although the blocks of FIGS. 13-17 are illustrated as being in a specific order, any of the blocks of FIGS. 13-17 may be combined, made concurrent, and/or re-ordered without departing from the scope of the invention. Accordingly, departures may be made from such details without departing from the spirit or scope of applicants' general inventive concept.

Other modifications will be apparent to one of ordinary skill in the art. Therefore, the invention lies in the claims hereinafter appended.

What is claimed is:

1. In a system for placing collated sheets into an envelope, a central controller including a virtual converter control module;

a plurality of document handling modules;

a framed network fieldbus communication system, providing communication protocol coupled to said central controller and to modules in said plurality of modules; and said central controller configured to communicate through said framed network fieldbus communication system using said communication protocol, to sense system parameters and control said modules in response thereto, thereby moving said collated sheets toward said envelope, and placing collated sheets into an envelope, in real time response to said sensing, and said central controller configured to simulate the operation of the system in said virtual converter control module and compare the operation of the system with the operation of the virtual converter control module.

2. In the system of claim 1, said framed network fieldbus communication system comprising means for controlling said placing system, said central controller operably communicating with said system for placing collated sheets through said network fieldbus communication protocol means for controlling said system.

3. In the system of claim 1, said system including feeding means to feed a web of material into a cutting means for cutting said web of material into a plurality of sheets.

4. In the system of claim 1, said system including cutting means for cutting a web of material into a plurality of sheets.

5. In the system of claim 1, said system including folding means for folding at least one of a sheet or said collated sheets.

6. In the system of claim 1, said system including accumulating means for accumulating at least two sheets into said collated sheets.

7. In the system of claim 1, said system including inserting means for inserting at least one insert to said collated sheets.

8. In the system of claim 1, said system including stuffing means for stuffing said collated sheets into said envelope.

9. In the system of claim 1, said system including buffering means for buffering at least one of a sheet or said collated sheets.

10. In the system of claim 1 wherein the placing system includes a plurality of functions on one or more collated sheets, the placing system further including respective sensors respectively oriented operationally with at least two of said functions respectively, said central controller communicating with said respective sensors through said framed network fieldbus communication protocol.

11. A system as in claim 1 wherein said controller communicates with said modules in said plurality of modules serially through said communication protocol.

12. A system as in claim 1 wherein modules of said plurality of modules include sensor and prime movers directly controlled by said central controller through said communication protocol provided by said framed network fieldbus communication system.

* * * * *